US008737877B2

(12) United States Patent
Suzuki et al.

(10) Patent No.: US 8,737,877 B2
(45) Date of Patent: May 27, 2014

(54) FIXING DEVICE HAVING ADJUSTMENT MECHANISM FOR ADJUSTING SHEET DISCHARGING DIRECTION

(75) Inventors: Noboru Suzuki, Komaki (JP); Kenji Takeuchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 424 days.

(21) Appl. No.: 13/014,836

(22) Filed: Jan. 27, 2011

(65) Prior Publication Data

US 2011/0188909 A1 Aug. 4, 2011

(30) Foreign Application Priority Data

Jan. 29, 2010 (JP) ..... 2010-018241
Jan. 29, 2010 (JP) ..... 2010-018247

(51) Int. Cl.
*G03G 15/16* (2006.01)

(52) U.S. Cl.
USPC ..... 399/122; 399/329; 219/216

(58) Field of Classification Search
USPC ..... 399/122
See application file for complete search history.

(56) References Cited

U.S. PATENT DOCUMENTS 5,017,970 A * 5/1991 Sakata ..... 399/67
5,303,016 A * 4/1994 Oda et al. ..... 399/329
5,708,926 A 1/1998 Sagara et al.
7,962,082 B2 6/2011 Takahashi et al.
8,009,998 B2 8/2011 Kajita
8,369,730 B2 * 2/2013 Fujimoto ..... 399/67
8,452,218 B2 * 5/2013 Fujiwara et al. ..... 399/329
8,463,150 B2 * 6/2013 Yoshikawa ..... 399/68
8,489,007 B2 * 7/2013 Fujiwara et al. ..... 399/329
8,515,312 B2 * 8/2013 Yamada ..... 399/122
8,611,802 B2 * 12/2013 Suzuki et al. ..... 399/329

(Continued)

FOREIGN PATENT DOCUMENTS

JP 06-222698 A 8/1994
JP 06-236122 8/1994

(Continued)

OTHER PUBLICATIONS

English machine translation of Naito et al. (JP 2009-168909 A); "Fixing Device and Image Forming Apparatus"; published Jul. 30, 2009; by Naito, Yasutaka; and Ohara, Hideaki.*

(Continued)

*Primary Examiner* — David Gray
*Assistant Examiner* — Geoffrey Evans
(74) *Attorney, Agent, or Firm* — Banner & Witcoff, Ltd.

(57) ABSTRACT

A fixing device for thermally fixing a developer image to a sheet fed in a sheet feeding direction includes: a tubular flexible fusing member; a heater; a nip member; a resiliently deformable backup member; and an adjustment mechanism. The fusing member has an inner peripheral surface defining an internal space. The heater is disposed in the internal space and radiates radiant heat. The nip member is disposed in the internal space and receives the radiant heat from the heater. The inner peripheral surface is in sliding contact with the nip member. The resiliently deformable backup member provides a nip region in cooperation with the nip member upon nipping the fusing member between the backup member and the nip member. The adjustment mechanism moves the nip member between a first position and a second position different from the first position in the sheet feeding direction to adjust the sheet feeding direction.

25 Claims, 20 Drawing Sheets

(56) References Cited

U.S. PATENT DOCUMENTS

| | | | | |
|---|---|---|---|---|
| 8,620,182 | B2 * | 12/2013 | Suzuki | 399/122 |
| 2004/0151515 | A1 * | 8/2004 | Nakayama | 399/67 |
| 2006/0083529 | A1 * | 4/2006 | Akizuki et al. | 399/69 |
| 2008/0298824 | A1 | 12/2008 | Kanno | |
| 2009/0010688 | A1 | 1/2009 | Takahashi et al. | |
| 2009/0208264 | A1 | 8/2009 | Fujiwara et al. | |
| 2009/0297180 | A1 | 12/2009 | Kajita | |
| 2010/0330494 | A1 * | 12/2010 | Condello et al. | 430/124.3 |
| 2011/0135350 | A1 * | 6/2011 | Barton et al. | 399/323 |
| 2011/0150543 | A1 * | 6/2011 | Fujiwara et al. | 399/328 |
| 2011/0158716 | A1 * | 6/2011 | Fujiwara et al. | 399/329 |
| 2011/0188908 | A1 * | 8/2011 | Ishida et al. | 399/330 |
| 2011/0236069 | A1 * | 9/2011 | Arikawa et al. | 399/122 |
| 2011/0305473 | A1 * | 12/2011 | Tamaki | 399/67 |
| 2012/0141174 | A1 * | 6/2012 | Kurita et al. | 399/329 |
| 2013/0195527 | A1 * | 8/2013 | Suzuki et al. | 399/329 |
| 2013/0251421 | A1 * | 9/2013 | Ryu et al. | 399/329 |
| 2013/0330103 | A1 * | 12/2013 | Takahashi | 399/122 |
| 2013/0336692 | A1 * | 12/2013 | Kondo et al. | 399/336 |

FOREIGN PATENT DOCUMENTS

| | | | |
|---|---|---|---|
| JP | 07-219362 | A | 8/1995 |
| JP | 08-328406 | | 12/1996 |
| JP | 2002-108119 | A | 4/2002 |
| JP | 2007-171749 | A | 7/2007 |
| JP | 2008-129092 | A | 6/2008 |
| JP | 2008-233886 | | 10/2008 |
| JP | 2008256918 | A * | 10/2008 |
| JP | 2008-275886 | A | 11/2008 |
| JP | 2008-298989 | | 12/2008 |
| JP | 2009-015141 | A | 1/2009 |
| JP | 2009-069210 | | 4/2009 |
| JP | 2009-168909 | A | 7/2009 |
| JP | 2009288493 | A | 12/2009 |
| JP | 2010-020129 | A | 1/2010 |

OTHER PUBLICATIONS

English machine translation of Mogi (JP 07-219362 A); "Fixing Device"; published Aug. 18, 1995; by Mogi, Junichi.*

English machine translation of Watanabe et al. (JP 2008-256918 A); "Fixing Unit and Image Forming Apparatus Using the Same"; published Oct. 23, 2008; by Watanabe, Shigeru; Goto, Yasutaka; Arikawa, Kiichiro; and Fukuda, Takeshi.*

English machine translation of Hasenami et al. (JP 2007-171749 A); "Fixing Device and Image Forming Apparatus"; published Jul. 5, 2007; by Hasenami, Shigehiko; and Uehara, Yasuhiro.*

JP Office Action dated Nov. 15, 2011, corresponding Application No. 2010-018235; English Abstract.

JP Office Action mailed May 8, 2012, JP Appln. 2010-018235, English Translation.

JP Office Action mailed Mar. 26, 2013, JP Application No. 2010-018241, English translation.

CN Office Action mailed Feb. 8, 2013, CN Appln. 201110034249.0, English translation.

JP Office Action mailed Mar. 19, 2013, JP Appln. 2010-018235, English translation.

JP Office Action dated Feb. 7, 2012, in corresponding Application No. 2010-018235; English Translation.

JP Office Action dated Dec. 20, 2011, JP Application 2010-018247, English Translation.

Co-pending U.S. Appl. No. 13/014,815, filed Jan. 27, 2011.

US Office Action dtd Oct. 5, 2012, U.S. Appl. No. 13/014,815.

Final Office Action received in U.S. Appl. No. 13/014,815 mailed May 15, 2013.

Non-final Office Action received in U.S. Appl. No. 13/014,815 mailed Sep. 12, 2013.

* cited by examiner

FIXING DEVICE HAVING ADJUSTMENT MECHANISM FOR ADJUSTING SHEET DISCHARGING DIRECTION

CROSS REFERENCE TO RELATED APPLICATION

This application claims priorities from Japanese Patent Applications Nos. 2010-018241 filed Jan. 29, 2010 and 2010-018247 filed Jan. 29, 2010. The entire content of each of these priority applications is incorporated herein by reference. The present application closely relates to a co-pending US patent application (based on Japanese patent application No. 2010-028235 filed Jan. 29, 2010) which is incorporated herein by reference.

TECHNICAL FIELD

The present invention relates to a fixing device that thermally fixes a transferred developing agent image to a sheet.

BACKGROUND

A conventional thermal fixing device for an electro-photographic type image forming device includes a tubular fusing film, a heater disposed in an internal space of the fusing film, a pressure roller, and a nip plate defining a nip region relative to the pressure roller through the fusing film. While a recording sheet is conveyed in the nip region, a developing agent image formed on the recording sheet is thermally fixed.

SUMMARY

In such a fixing device, the recording sheet is curled up about an axis extending in a sheet widthwise direction due to fixing operation. An amount of curl varies in types of the recording sheets, such as plain paper and thick paper. Different amounts of curl have different directions of the recording sheet to be discharged from the fixing device. Therefore, the sheet discharging direction (i.e. a sheet feeding direction) needs to be adjusted. Further, adjustment of the sheet discharging direction is desired when performing normal discharge for discharging the recording sheet from the fixing device to a discharge tray disposed at a top surface of the image forming device and straight discharge for discharging the recording sheet from an opening formed in a rear wall of the image forming device onto a rear cover in an open state. In view of the foregoing, it is an object of the present invention to provide a fixing device capable of adjusting a sheet feeding direction.

In order to attain the above and other objects, the present invention provides a fixing device for thermally fixing a developing agent image to a sheet fed in a sheet feeding direction including: a tubular flexible fusing member; a heater; a nip member; a resiliently deformable backup member; and an adjustment mechanism. The tubular flexible fusing member has an inner peripheral surface defining an internal space. The heater is disposed in the internal space and configured to radiate radiant heat. The nip member is disposed in the internal space and configured to receive the radiant heat from the heater. The inner peripheral surface is in sliding contact with the nip member. The resiliently deformable backup member is configured to provide a nip region in cooperation with the fusing member upon nipping the fusing member between the backup member and the nip member. The adjustment mechanism is configured to move the nip member between a first position and a second position different from the first position in the sheet feeding direction to adjust the sheet feeding direction.

DETAILED DESCRIPTION

Figure 1:
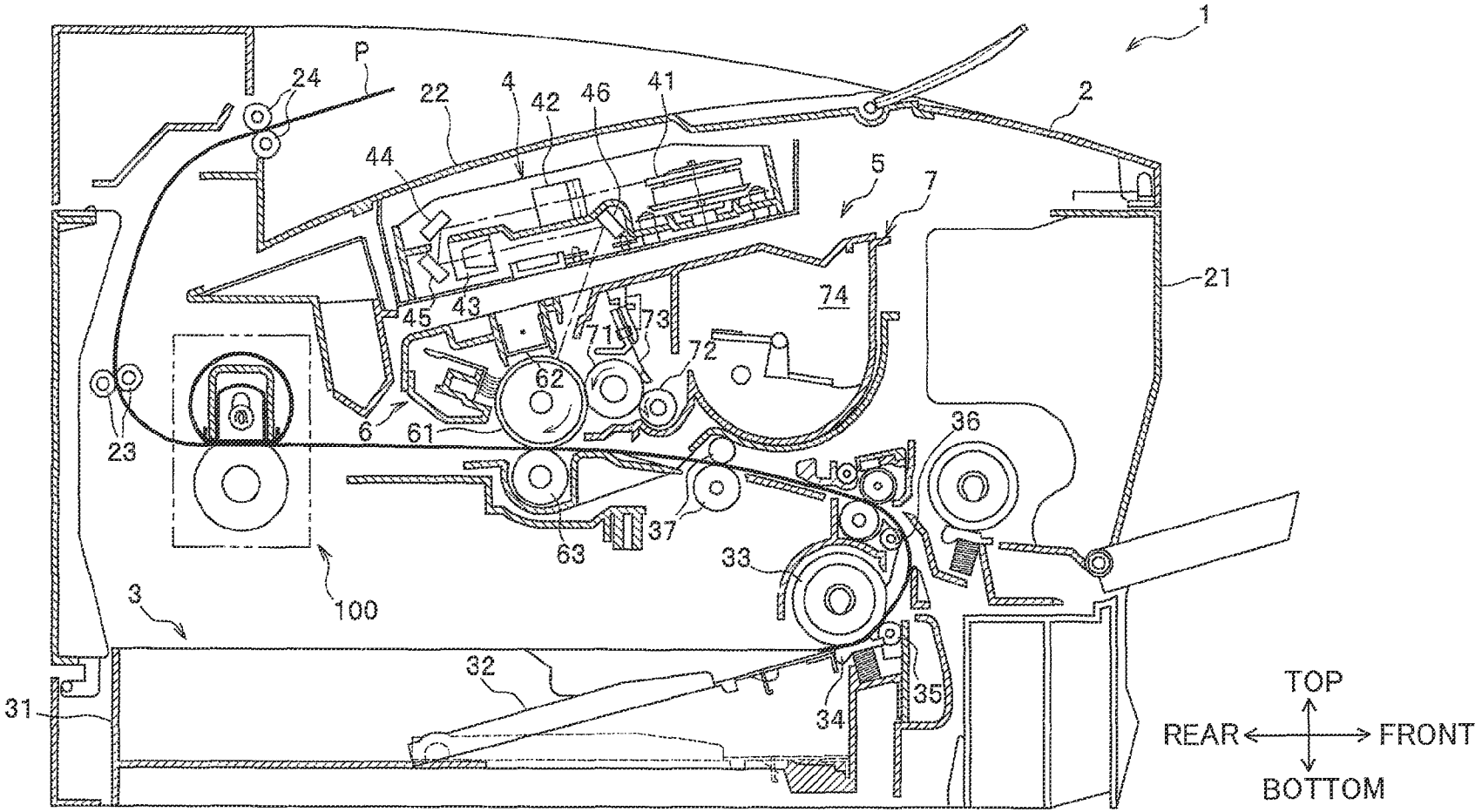
FIG. 1 is a schematic cross-sectional view showing a structure of a laser printer having a fixing device according to a first embodiment of the present invention.

Next, a general structure of a laser printer as an image forming device will be described with reference to FIG. 1. The laser printer 1 shown in FIG. 1 is provided with a fixing device 100 according to a first embodiment of the present invention. A detailed structure of the fixing device 100 will be described later while referring to FIGS. 2 to 10B.

<General Structure of Laser Printer>

As shown in FIG. 1, the laser printer 1 includes a main frame 2 with a movable front cover 21. Within the main frame 2, a sheet supply unit 3 for supplying a sheet P, an exposure unit 4, a process cartridge 5 for transferring a toner image (developing agent image) on the sheet P, and the fixing device 100 for thermally fixing the toner image onto the sheet P are provided.

Throughout the specification, the terms "above", "below", "right", "left", "front", "rear" and the like will be used assuming that the laser printer 1 is disposed in an orientation in which it is intended to be used. More specifically, in FIG. 1, a left side and a right side are a rear side and a front side, respectively.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35, 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 passing through the paper dust removing rollers 35, 36, and the registration rollers 37.

The exposure unit 4 is disposed at an upper portion of the main frame 2. The exposure unit 4 includes a laser emission unit (not shown), a rotatably driven polygon mirror 41, lenses 42, 43, and reflection mirrors 44, 45, 46. In the exposure unit 4, the laser emission unit is adapted to project a laser beam (indicated by a dotted line in FIG. 1) based on image data so that the laser beam is deflected by or passes through the polygon mirror 41, the lens 42, the reflection mirrors 44, 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachable or attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and a transfer roller 63. The developing unit 7 is detachably mounted to the drum unit 6. The developing unit 7 includes a developing roller 71, a toner supply roller 72, a regulation blade 73, and a toner accommodating portion 74 in which toner (developing agent) is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the regulation blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 so as to be discharged on a discharge tray 22.

<Detailed Structure of Fixing Device>

Figure 2:
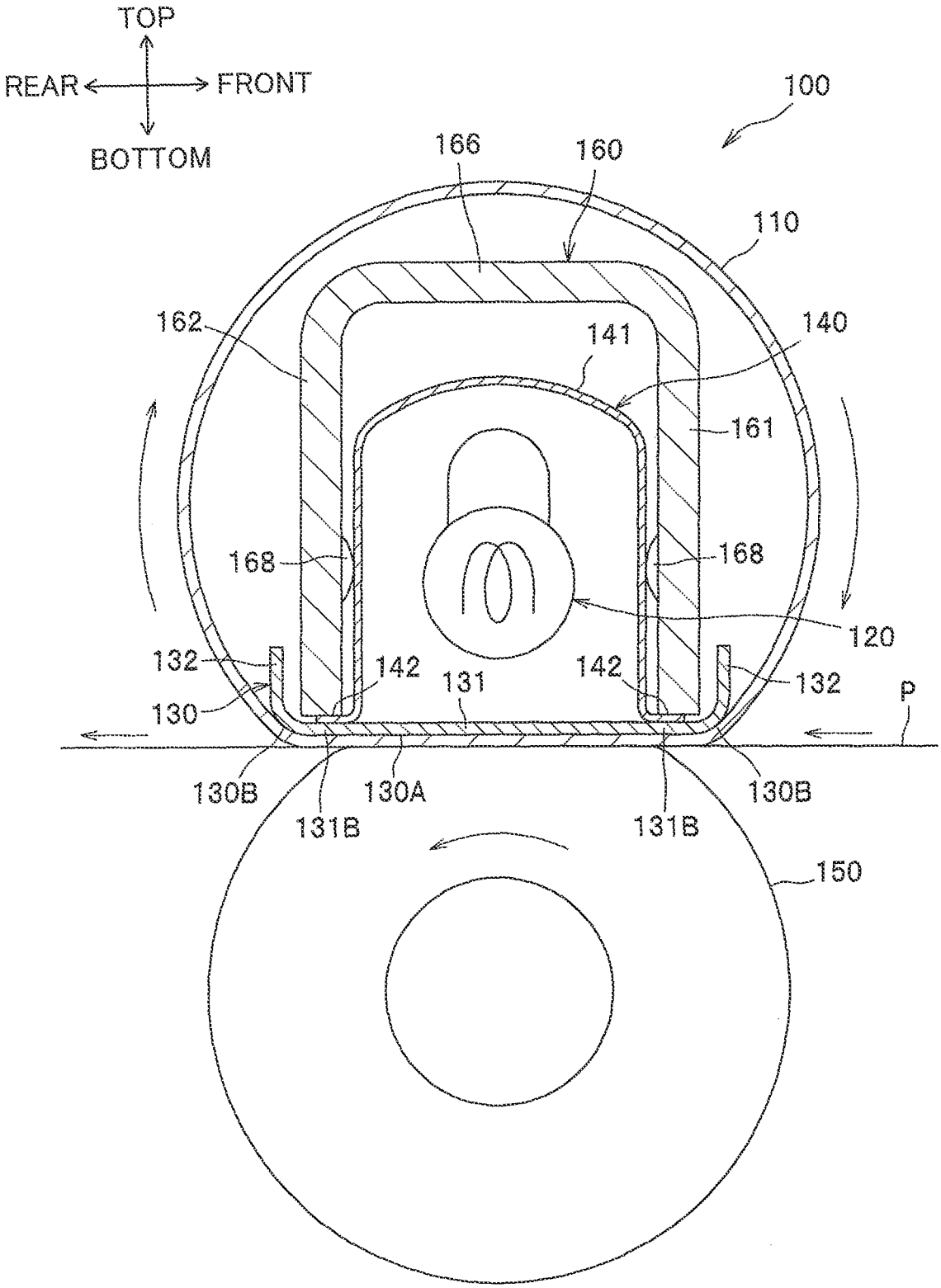
FIG. 2 is a schematic cross-sectional view showing a structure of the fixing device according to the first embodiment.

As shown in FIG. 2, the fixing device 100 includes a flexible tubular fusing member such as a tube or film 110, a halogen lamp 120, a nip plate 130 as a nip member, a reflection plate 140, a pressure roller 150 as a backup member, and a stay 160.

The fusing film (fixing film) 110 is of a tubular configuration having heat resistivity and flexibility. Each widthwise (right and left) end portion of the fusing film 110 is guided by a guide member 170 (described later) fixed to a fixing frame 180 (describe later) of the fixing device 100 so that the fusing film 110 is circularly movable.

The halogen lamp 120 is a heater to heat the nip plate 130 and the fusing film 110 for heating toner on the sheet P. The halogen lamp 120 is positioned at an internal space of the fusing film 110 and is spaced away from an inner peripheral surface of the fusing film 110 as well as from an inner surface of the nip plate 130 by a predetermined distance.

Figure 3:
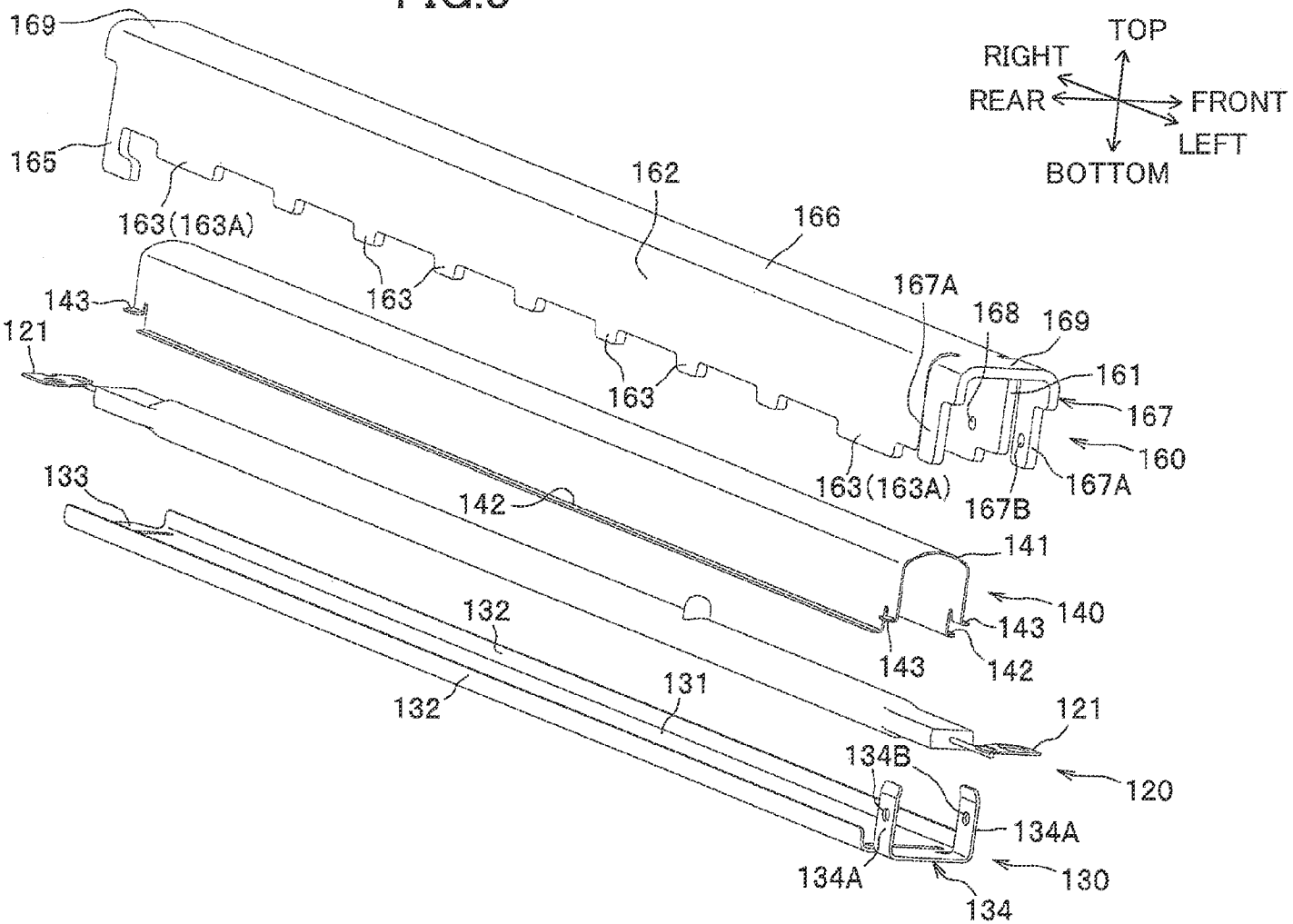
FIG. 3 is an exploded perspective view showing a halogen lamp, a nip plate, a reflection plate, and a stay in the first embodiment.

The halogen lamp 120 has right and left end portions, and each end portion is provided with a planar terminal 121 (FIG. 3). The terminal 121 is electrically connected to a power source (not shown) provided within the main frame 2 of the laser printer 1 via a flexible line.

The nip plate 130 is adapted for receiving pressure from the pressure roller 150 and for receiving radiant heat from the halogen lamp 120. The nip plate 130 transmits radiant heat from the halogen lamp 120 to the toner on the sheet P through the fusing film 110. To this effect, the nip plate 130 is positioned such that the inner peripheral surface of the fusing film 110 is moved slidably therewith through grease.

The nip plate 130 has a generally U-shaped cross-section made from a material such as aluminum having a thermal conductivity higher than that of the stay 160 (described later) made of steel. More specifically, for fabricating the nip plate 130, an aluminum plate is bent into U-shape to provide a base portion 131 linearly extending in a frontward/rearward direction and upwardly folded portions 132 (that is oriented in a direction from the pressure roller 150 to the nip plate 130).

The U-shaped nip plate 130 has a lower surface, that is, a surface confronting the pressure roller 150. The lower surface has a linear shaped flat portion 130A having a curvature of 0 (zero) and a curved portion 130B having a curvature greater than 0 (zero).

The base portion 131 has end portions 131B in the frontward/rearward direction. The base portion 131 has an inner (upper) surface painted with a black color or provided with a heat absorbing member so as to efficiently absorb radiant heat from the halogen lamp 120.

As shown in FIG. 3, the nip plate 130 has a right end portion provided with an insertion portion 133 extending flat, and a left end portion provided with an engagement portion 134. The engagement portion 134 has U-shaped configuration as viewed from a left side including side wall portions 134A extending upward and formed with engagement holes 134B.

The reflection plate 140 is adapted to reflect radiant heat radiating in the frontward/rearward direction and in the upper direction from the halogen lamp 120 toward the nip plate 130 (toward the inner surface of the base portion 131). As shown in FIG. 2, the reflection plate 140 is positioned within the fusing film 110 and surrounds the halogen lamp 120, with a predetermined distance therefrom. Thus, radiant heat from the halogen lamp 120 can be efficiently concentrated onto the nip plate 130 to promptly heat the nip plate 130 and the fusing film 110.

The reflection plate 140 is configured into U-shape in cross-section and is made from a material such as aluminum having high reflection ratio regarding infrared ray and far infrared ray. The reflection plate 140 has a U-shaped reflection portion 141 and a flange portion 142 extending outward from each end portion of the reflection portion 141 in the frontward/rearward direction. A mirror surface finishing is available on the surface of the aluminum reflection plate 140 for specular reflection in order to enhance heat reflection ratio. As shown in FIG. 3, two engagement sections 143 are provided at each widthwise (right and left) end of the reflection plate 140. Each engagement section 143 is positioned higher than the flange portion 142.

As shown in FIG. 2, the pressure roller 150 is positioned below the nip plate 130. The pressure roller 150 is made from a resiliently deformable material. The pressure roller 150 is resiliently deformed to nip the fusing film 110 in cooperation with the nip plate 130 to provide a nip region for nipping the sheet P between the pressure roller 150 and the fusing film 110. In other words, the pressure roller 150 presses the nip plate 130 through the fusing film 110 for providing the nip region between the pressure roller 150 and the fusing film 110.

When the nip plate 130 is at a first position shown in FIG. 10A as described later in detail, the lower surface of the nip plate 130 has a region X including a portion PA1 that is pressed by the pressure roller 150. The portion PA1 has a curvature of 0 (zero). The portion PA1 is a most downstream portion of the lower surface pressed by the pressure roller 150 in the sheet feeding direction when the pressure roller 150 is at the first position, and exerts influence on a sheet discharging direction of the sheet P to be discharged from the fixing device 100.

Figure 10A:
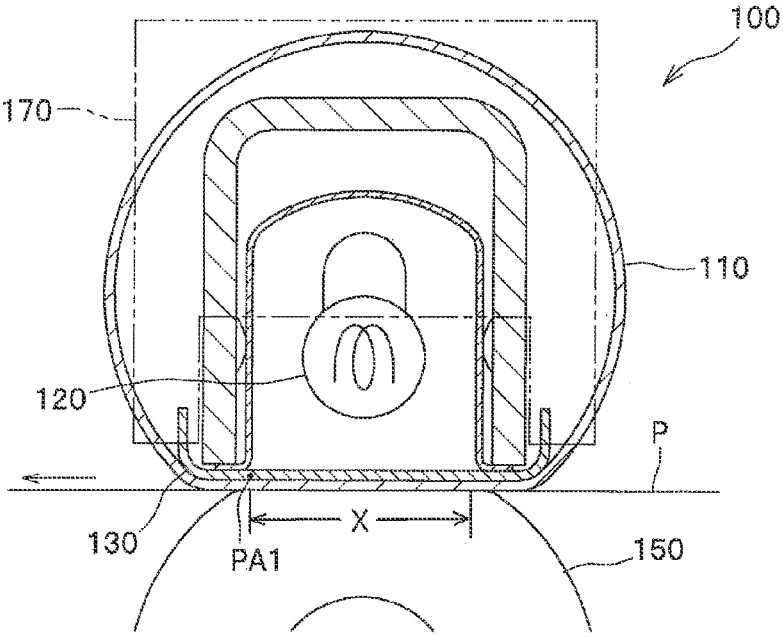
FIGS. 10A and 10B are explanatory views showing a relationship between the nip plate and the pressure roller when a sheet discharging direction is changed in the first embodiment.
Figure 10B:
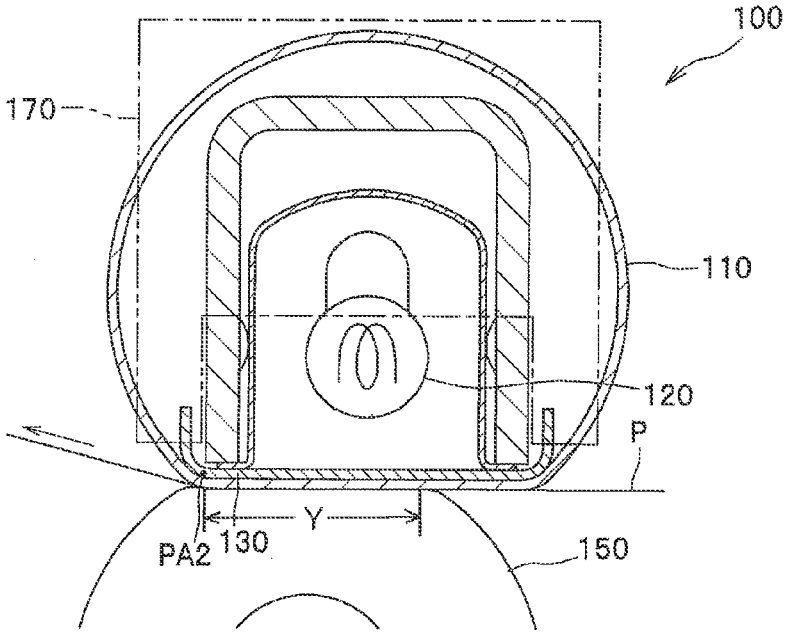

Further, when the nip plate 130 is at a second position shown in FIG. 10B that is positioned upstream of the first position in the sheet feeding direction, the lower surface of the nip plate 130 has a region Y including a portion PA2 that is pressed by the pressure roller 150. The region Y is partly overlapped with the region X. The portion PA2 has a curvature different from that of the portion PA1, and the curvature is greater than 0 (zero). The portion PA2 is a most downstream portion of the lower surface pressed by the pressure roller 150 in the sheet feeding direction when the pressure roller 150 is at the second position, and exerts influence on the sheet discharging direction.

The pressure roller 150 is rotationally driven by a drive motor (not shown) disposed in the main frame 2. By the rotation of the pressure roller 150, the fusing film 110 is circularly moved along the nip plate 130 because of a friction force generated therebetween or between the sheet P and the fusing film 110. A toner image on the sheet P can be thermally fixed thereto by heat and pressure during passage of the sheet P at the nip region between the pressure roller 150 and the fusing film 110.

The stay 160 is adapted to support the end portions 131B of the nip plate 130 through the flange portion 142 of the reflection plate 140 for maintaining rigidity of the nip plate 130. The stay 160 has a U-shape configuration in conformity with the outer shape of the reflection portion 141 covering the reflection plate 140. For fabricating the stay 160, a highly rigid member such as a steel plate is folded into U-shape to have a top wall 166, a front wall 161 and a rear wall 162. As shown in FIG. 3, each of the front wall 161 and the rear wall 162 has a lower end portion provided with comb-like contact portions 163.

As a result of assembly of the nip plate 130 together with the reflection plate 140 and the stay 160, the comb-like contact portions 163 are nipped between the right and left engagement sections 143. That is, the right engagement section 143 is in contact with the rightmost contact portion 163A, and the left engagement section 143 is in contact with the leftmost contact portion 163A. As a result, displacement of the reflection plate 140 in a rightward/leftward direction (widthwise direction) due to vibration caused by operation of the fixing device 100 can be restrained by the engagement between the engagement sections 143 and the comb-like contact portions 163A.

The front and rear walls 161, 162 have right end portions provided with L-shaped engagement legs 165 each extending downward and then leftward. The insertion portion 133 of the nip plate 130 is insertable into a space between the confronting engagement legs 165 and 165. Further, each end portion 131B of the base portion 131 is abuttable on each engagement leg 165 as a result of the insertion.

The top wall 166 has a left end portion provided with a retainer 167 having U-shaped configuration. The retainer 167 has a pair of retaining walls 167A whose inner surfaces are provided with engagement bosses 167B each being engageable with each engagement hole 134B.

As shown in FIGS. 2 and 3, each widthwise (left and right) end portion of each of the front wall 161 and the rear wall 162 has an inner surface provided with two abutment bosses 168 protruding inward in abutment with the reflection portion 141 in the frontward/rearward direction. Therefore, displacement of the reflection plate 140 in the frontward/rearward direction due to vibration caused by operation of the fixing device 100 can be restrained because of the abutment of the reflection portion 141 with the bosses 168.

The stay 160 has upper left and right end portions, each provided with a supported portion 169 protruding outward in the rightward/leftward direction. Each of the supported portions 169 is supported to the guide member 170 described later.

Assembling procedure of the reflection plate 140 and the nip plate 130 to the stay 160 will be described. First, the reflection plate 140 is temporarily assembled to the stay 160 by the abutment of the outer surface of the reflection portion 141 on the abutment bosses 168. In this case, the engagement sections 143 are in contact with the widthwise endmost contact portions 163A.

Figure 4:
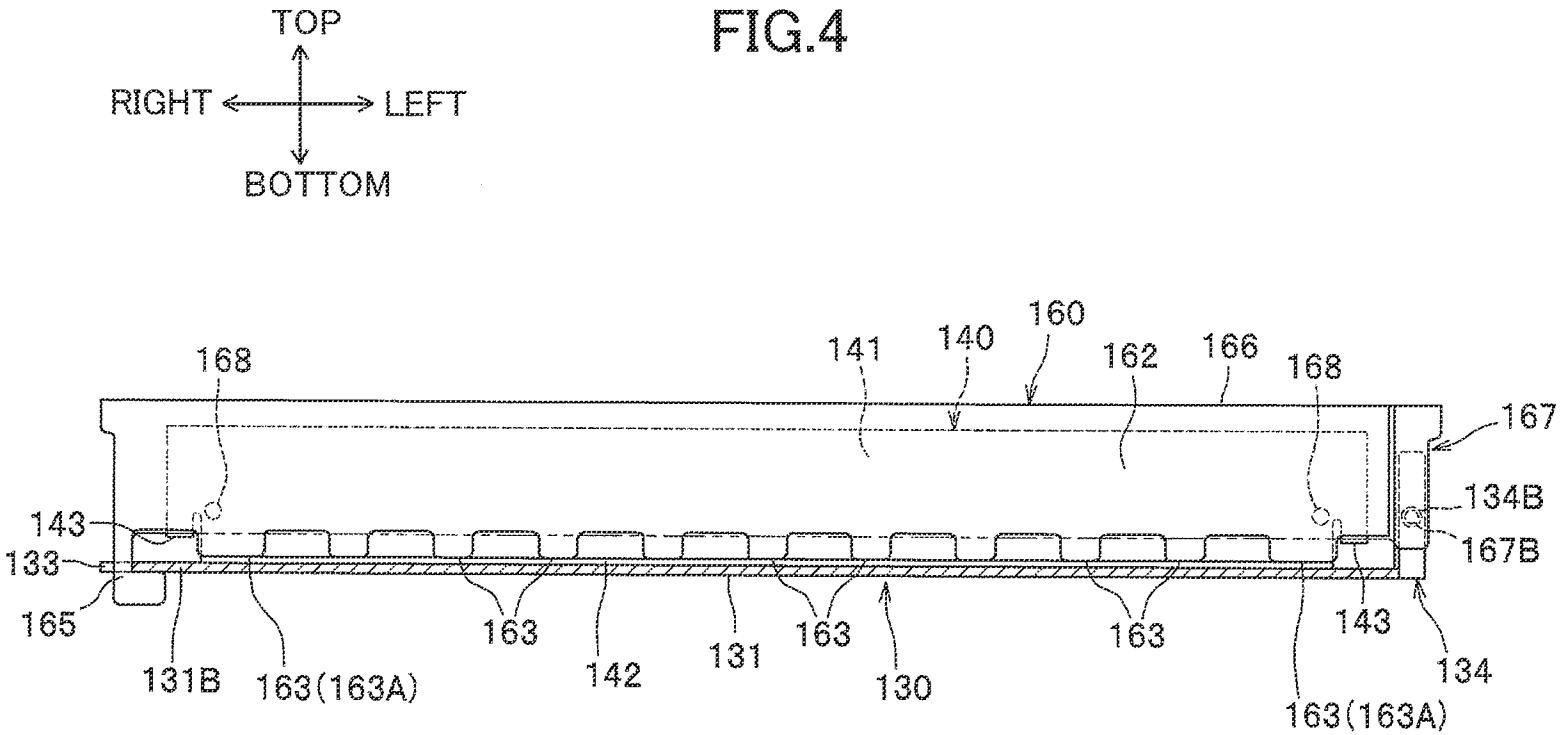
FIG. 4 is a rear view showing an assembled state of the nip plate, the reflection plate and the stay in the first embodiment.

Then, as shown in FIG. 4, the insertion portion 133 is inserted between the engagement legs 165 and 165, so that the base portion 131 can be brought into engagement with the engagement legs 165. Thereafter, the engagement bosses 167B are engaged with the engagement holes 134B. By this engagement, each flange portion 142 is sandwiched between the nip plate 130 and the stay 160. Thus, the nip plate 130 and the reflection plate 140 are held to the stay 160.

Vertical displacement of the reflection plate 140 due to vibration caused by operation of the fixing device 100 can be restrained, since the flange portions 142 are held between the nip plate 130 and the stay 160 as shown in FIG. 2. Thus, position of the reflection plate 140 relative to the nip plate 130 can be fixed.

Figure 5A:
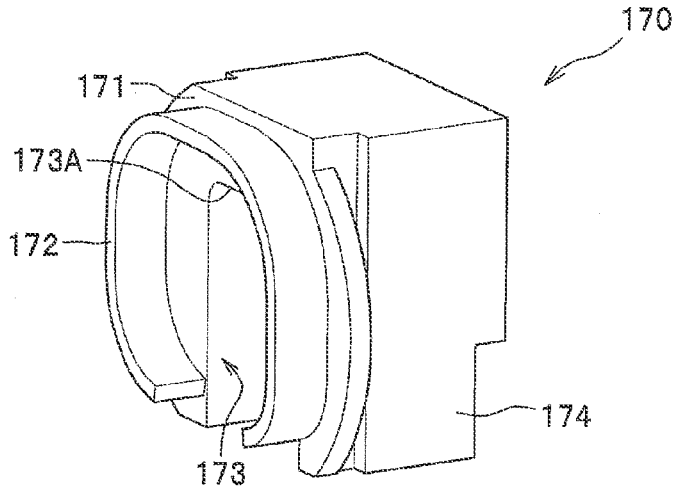
FIG. 5A is a perspective view of a guide member as viewed from a top side thereof in the first embodiment.

The stay 160 holding the nip plate 130 and the reflection plate 140, and the halogen lamp 120 are directly fixed to a pair of the guide members 170 shown in FIG. 5A. That is, the guide members 170 integrally support the nip plate 130, the reflection plate 140, the stay 160, and the halogen lamp 120.

The guide member 170 is made from a thermally insulation material such as resin. Each of the guide members 170 is disposed at each of the widthwise end portions of the fusing film 110 for guiding circular movement of the fusing film 110. More specifically, each of the guide members 170 is provided to restrain movement of the fusing film 110 in the rightward/leftward direction (in the axial direction).

As shown in FIG. 5A, the guide member 170 includes a restricting surface 171 for restricting widthwise movement of the fusing film 110, a guide portion 172 for preventing the fusing film 110 from deforming radially inward, and a supporting recess 173 for supporting the front wall 161, the rear wall 162 and the top wall 166 of the stay 160.

The guide portion 172 is a rib protruding inward from the restricting surface 171 in the rightward/leftward direction. The guide portion 172 has a generally C-shape having a bottom opening. The guide portion 172 is inserted into the tubular fusing film 110. That is, the guide portion 172 is in sliding contact with the inner peripheral surface of the fusing film 110 so as to restrain radially inward deformation of the fusing film 110. The bottom opening of the guide portion 172 serves as a space for accommodating the stay 160 that is inserted into the supporting recess 173.

Figure 5B:
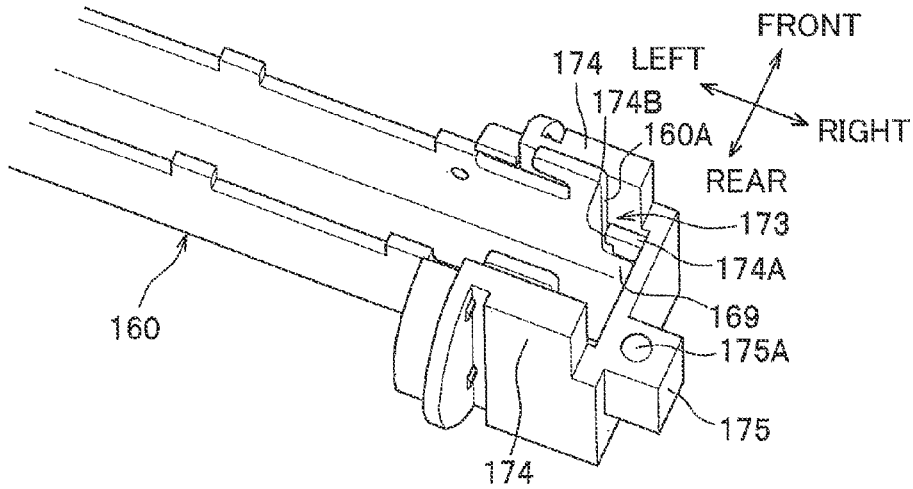
FIG. 5B is a perspective view of the guide member to which the stay is assembled as viewed from a bottom side thereof in the first embodiment.
Figure 5C:
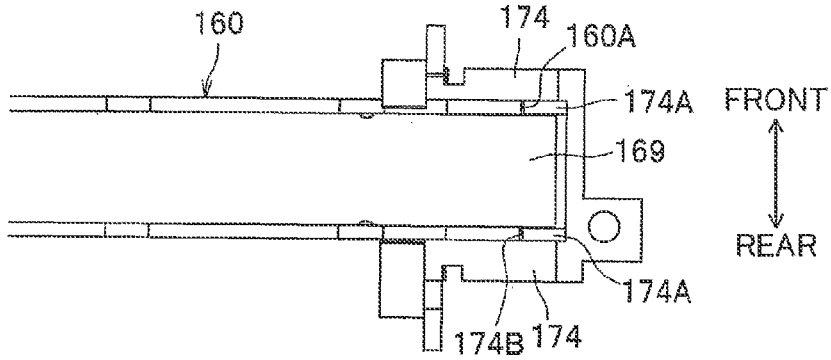
FIG. 5C is a bottom view of the guide member to which the stay is assembled in the first embodiment.

The supporting recess 173 opens inward in the rightward/leftward direction and has a bottom opening. The supporting recess 173 has a top wall 173A (FIG. 5A). The guide member 170 has a pair of side walls 174 arranged in confrontation with each other in the frontward/rearward direction. The pair of the side walls 174 defines the supporting recess 173 therebetween. Each of the side walls 174 has a protruding portion 174A as shown in FIGS. 5B and 5C. The protruding portion 174A is formed so as to protrude inward from a portion spaced apart away from the top wall 173A.

As shown in FIG. 5B, each of the supported portions 169 of the stay 160 is inserted into a portion between the top wall 173A and a pair of the protruding portions 174A. Hence, vertical movement of the supported portion 169 can be regulated by the top wall 173A and the pair of the protruding portion 174A. As a result, vertical displacement of the stay 160 relative to the guide member 170 can be restrained.

Further, each of the protruding portions 174A has an inner surface 174B in the rightward/leftward direction. The stay 160 has a pair of outer edge portions 160A (FIG. 5B) in the rightward/leftward direction. Each of the outer edge portions 160A is brought into abutment with each of the inner surfaces 174B. As a result, displacement of the stay 160 relative to the guide member 170 in the rightward/leftward direction (widthwise direction) due to vibration caused by operation of the fixing device 100 can be restrained by abutment of the protruding portions 174A with the stay 160.

Further, displacement of the stay 160 in the frontward/rearward direction can be restrained, since the stay 160 is supported between the pair of the side walls 174. As described above, the stay 160 is supported to the guide member 170, so that the nip plate 130 and the reflection plate 140 are integrally supported to the guide member 170 via the stay 160.

Figure 6:
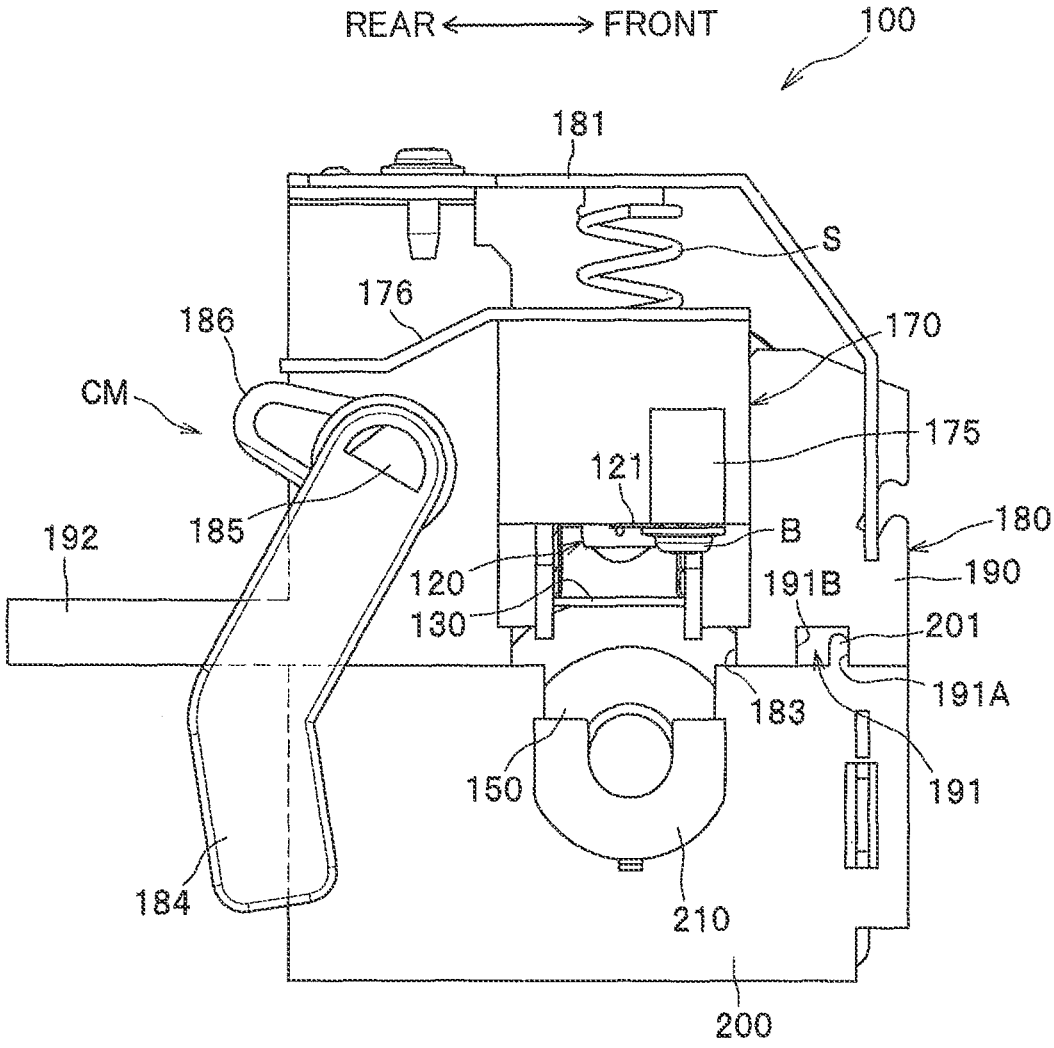
FIG. 6 is a left side view of the fixing device in which the nip plate is at a first position in the first embodiment.

As shown in FIGS. 5B and 5C, the guide member 170 has a holding portion 175 protruding outward from the guide member 170 in the rightward/leftward direction. The holding portion 175 is provided to fix the halogen lamp 120 to the guide member 170. The holding portion 175 has a lower surface formed with a hole 175A into which a bolt B (FIG. 6) is inserted. As shown in FIG. 6, the terminal 121 of the halogen lamp 120 is directly fixed to the lower surface of the holding portion 175 by the bolt B.

The guide member 170 with the above-described configuration retains the nip plate 130, the reflection plate 140, and the stay 160 therein, and is vertically movably supported to the fixing frame 180. The guide member 170 has an upper surface to which a support plate 176 (FIG. 6) is fixed. The support plate 176 is bent downward while extending rearward (toward a cam portion 186 (FIG. 6) described later).

The fixing frame 180 has an upper portion to which an upper frame 181 is fixed. A coil spring S is disposed above the support plate 176 and below the upper frame 181. The coil spring S constantly urges the support plate 176 and the guide member 170 downward (toward the pressure roller 150) relative to the upper frame 181. With this configuration, preferable nip pressure can be applied to the nip plate 130 and the pressure roller 150 when a printing operation is performed.

As shown in FIG. 6, the fixing frame 180 includes an upper casing 190 and a lower casing 200. The upper casing 190 is formed with a support groove 183. The guide member 170 is supported in the support groove 183 so as to be movable upward and downward relative to the upper casing 190.

The upper casing 190 is in engagement with the lower casing 200 so as not to be movable in an upward/downward direction but to be movable in the frontward/rearward direction relative to the lower casing 200. More specifically, the upper casing 190 is formed with a recess extending in the frontward/rearward direction, such as a T-shaped recess, and the lower casing 200 is provided with a T-shaped rib. The T-shaped rib is slidingly movable within the T-shaped recess in the frontward/rearward direction.

The lower casing 200 is fixed to the main frame 2 of the laser printer 1 (shown in FIG. 1). The lower casing 200 has a bearing portion 210 in which a shaft of the pressure roller 150 is rotatably supported. That is, the lower casing 200 rotatably supports the pressure roller 150 via the bearing portion 210.

The upper casing 190 is formed with a recessed portion 191 having a bottom opening. The recessed portion 191 defines a front wall 191A and a rear wall 191B. The upper casing 190 has a rear portion provided with an operation portion 192. The operation portion 192 can be held by a user, so that the user can move the upper casing 190 in the frontward/rearward direction via the operation portion 192.

The lower casing 200 is provided with a projecting portion 201 for selectively positioning the upper casing 190 (the nip plate 130) at either the first position (a position shown in FIG. 6) or the second position (a position shown in FIG. 9) in the sheet feeding direction (that is, a direction perpendicular to a confronting direction such that the nip plate 130 confronts the pressure roller 150 and an axial direction of the fusing film 110). The second position is disposed upstream of the first position in the sheet feeding direction. When the projecting portion 201 is in contact with the front wall 191A, the upper casing 190 (the nip plate 130) is provided at the first position. When the projecting portion 201 is in contact with the rear wall 191B, the upper casing 190 (the nip plate 130) is provided at the second position.

That is, in the first embodiment, an adjustment mechanism is provided to adjust the sheet discharging direction (the sheet feeding direction) by moving the nip plate 130 between the first position and the second position as a result of the movement of the upper casing 190 between the first position and the second position. The upper casing 190, the recessed portion 191, the operation portion 192, and the projecting portion 201 constitute the adjustment mechanism. The adjustment mechanism linearly moves the nip plate 130 in a direction substantially parallel to the sheet feeding direction relative to the backup member 150.

As shown in FIG. 6, the upper casing 190 has left and right side walls at which a release mechanism CM is provided. With the release mechanism CM, the nip plate 130 is moved so as to be spaced away from the pressure roller 150, thereby releasing the nip pressure between the nip plate 130 and the pressure roller 150. The release mechanism CM includes an operation lever 184, a pivot shaft 185, and two cam portions 186.

The operation lever 184 has one end which is integrally fixed to the pivot shaft 185. The pivot shaft 185 extends in the rightward/leftward direction through holes formed in the left and right side walls of the upper casing 190. The pivot shaft 185 is rotatably supported to the upper casing 190.

Figure 7:
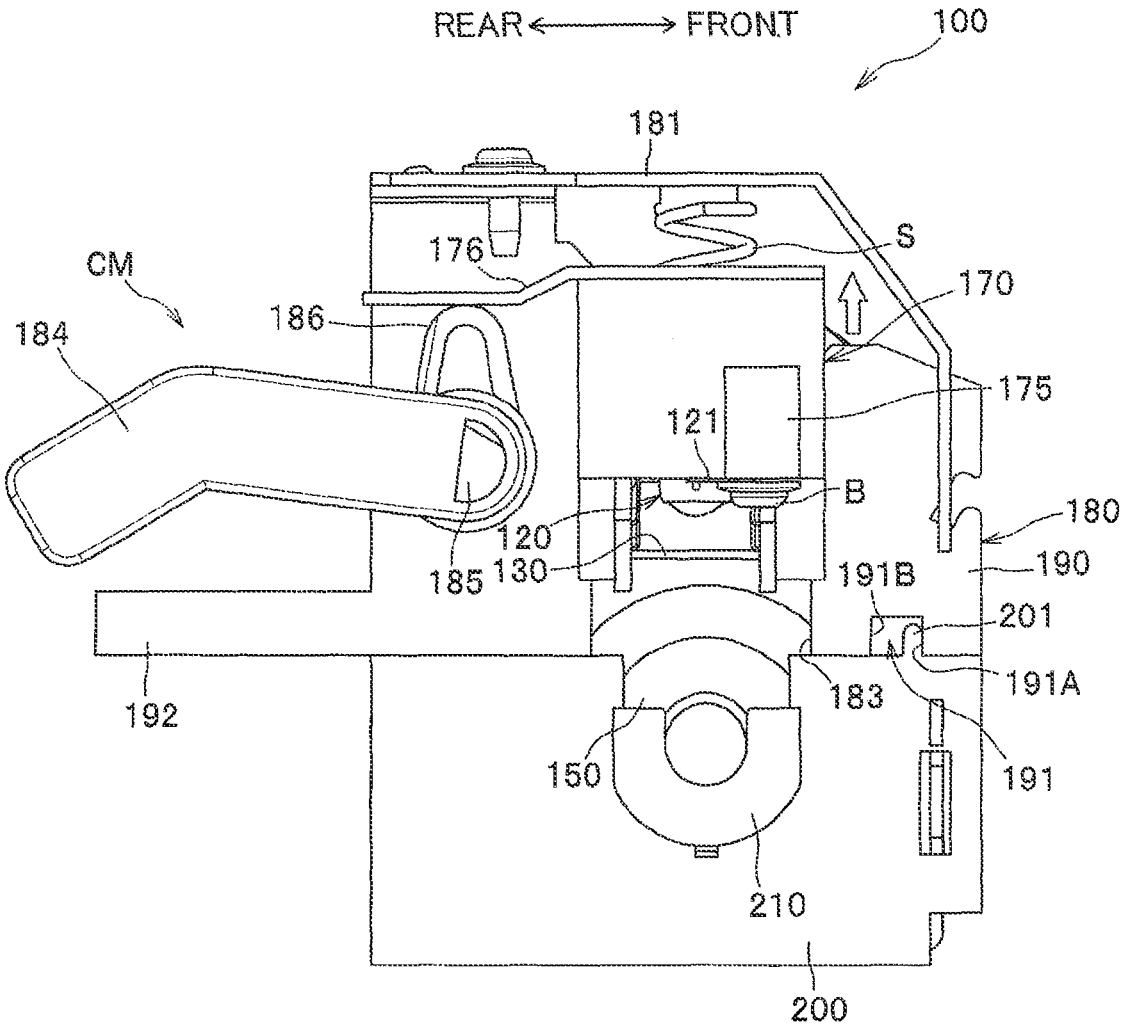
FIG. 7 is a left side view of the fixing device showing a state where a nip pressure is released when the nip plate is at the first position in the first embodiment.

Each of the cam portions 186 is integrally fixed to each widthwise (left and right) end portion of the pivot shaft 185 so as to radially outwardly protrude therefrom. When the operation lever 184 is pivotally moved so that the left and right cam portions 186 press the left and right support plates 176 upward respectively, the left and right guide members 170 ascend against the urging force of the coil spring S as shown in FIG. 7. As a result, the nip plate 130 is spaced away from the pressure roller 150, thereby releasing the nip pressure between the nip plate 130 and the pressure roller 150.

Figure 8:
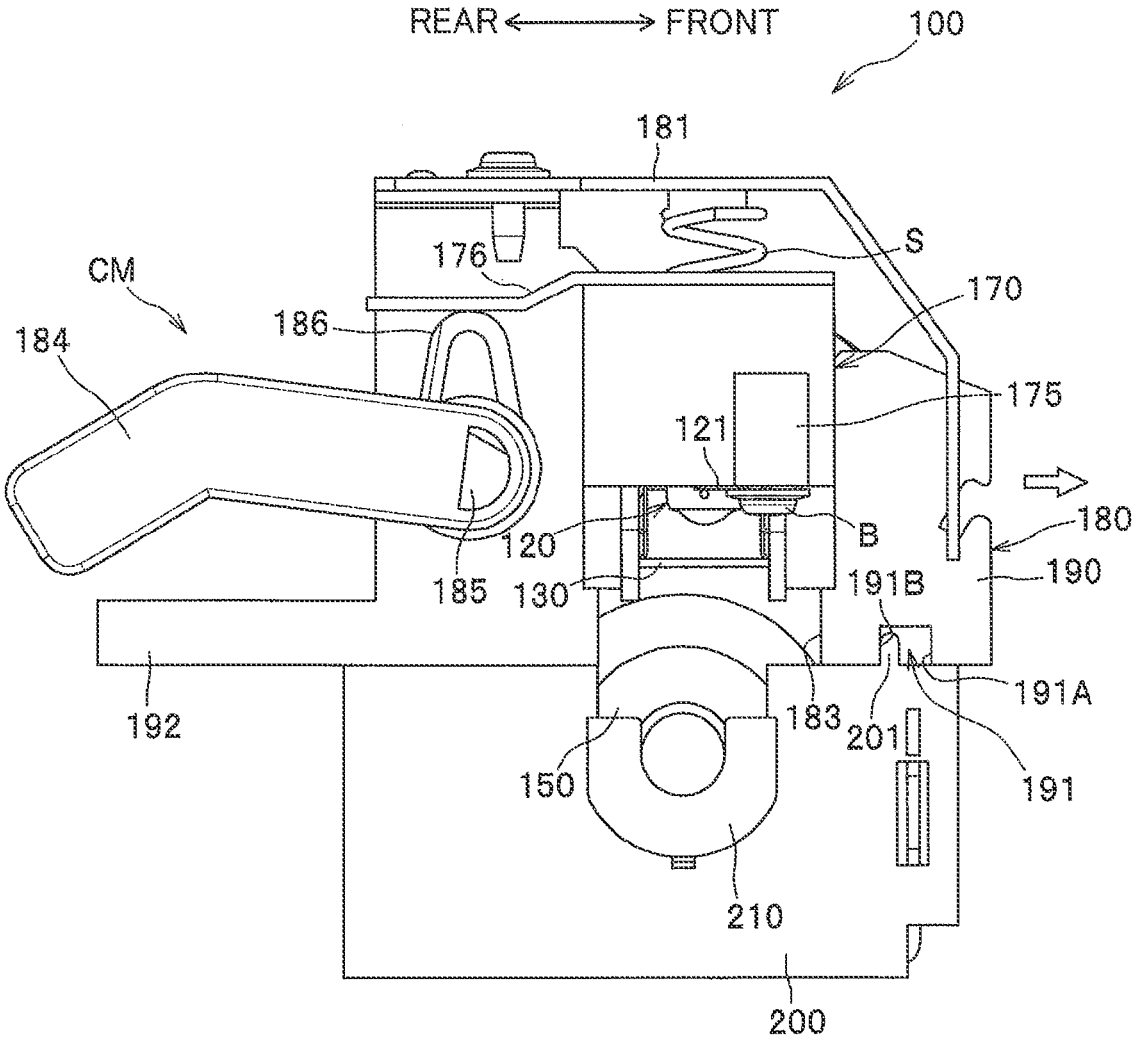
FIG. 8 is a left side view of the fixing device showing a state where the nip plate has been moved to a second position in the first embodiment.
Figure 9:
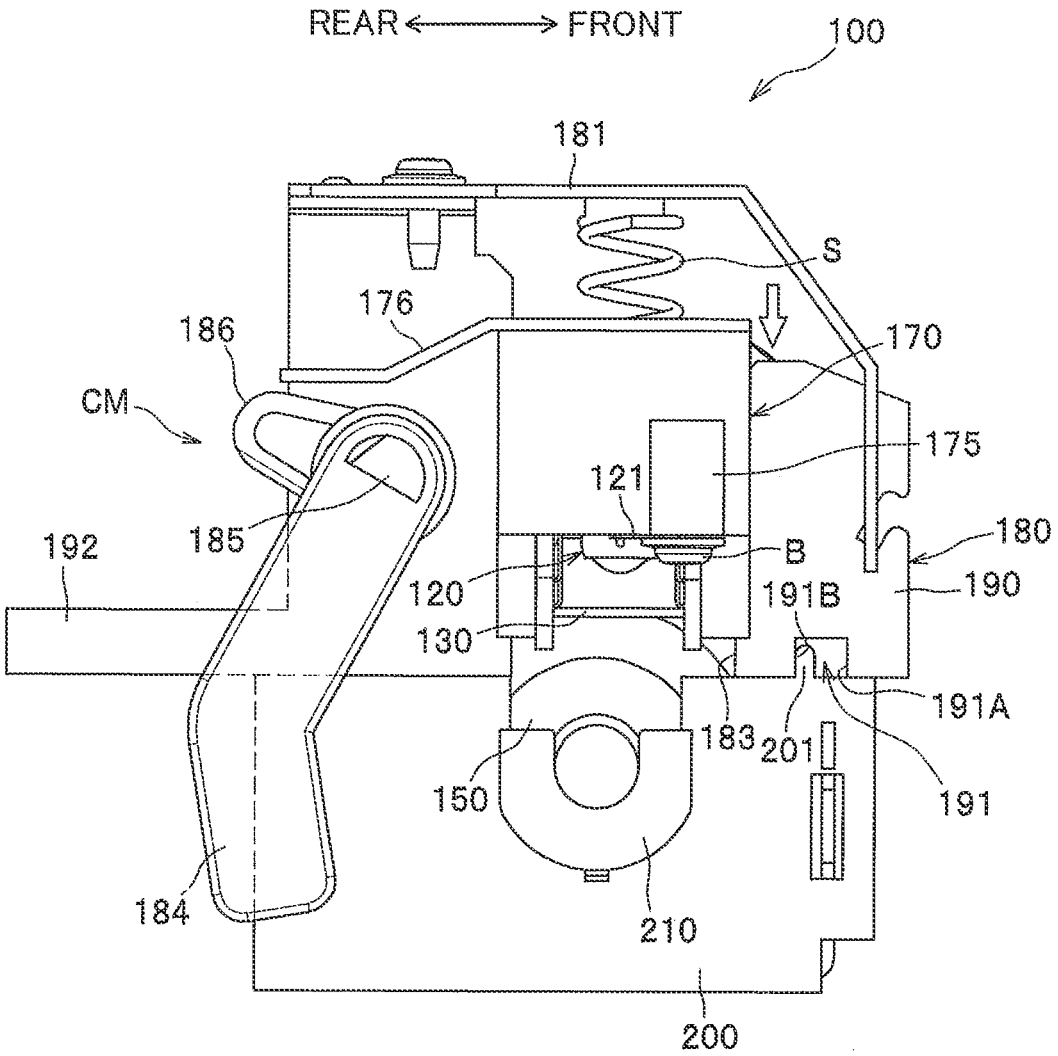
FIG. 9 is a left side view of the fixing device showing a state where the nip pressure is reapplied when the nip plate is at the second position in the first embodiment.

In this state, the user holds the operation portion 192 to move the upper casing 190 frontward. As shown in FIG. 8, the upper casing 190 is moved from the first position to the second position in the frontward/rearward direction. Then, as shown in FIG. 9, when the operation lever 184 is returned to its original position, the left and right cam portions 186 are moved away from the left and right support plates 176 respectively, so that the left and right guide members 170 descends by the urging force of the coil spring S. As a result, the nip plate 130 is pressed by the pressure roller 150, so that the nip pressure between the nip plate 130 and the pressure roller 150 is generated.

When the cam portions 186 are moved away from the support plates 176, and accordingly, the nip pressure between the nip plate 130 and the pressure roller 150 is generated, a sufficient friction force is generated between the upper casing 190 and the lower casing 200. Due to the friction force, the upper casing 190 cannot be moved in the frontward/rearward direction.

As described above, the nip plate 130 is moved to the second position shown in FIG. 10B from the first position shown in FIG. 10A. Hence, the most downstream portion of the lower surface of the nip plate 130 that is pressed by the pressure roller 150 is changed to the portion PA2 whose curvature is greater than 0 (zero) from the portion PA1 whose curvature is 0 (zero). In association therewith, the configuration of the pressure roller 150 is changed. That is, the pressure roller 150 at the second position has a configuration different from a configuration thereof at the first position.

Therefore, as shown in FIGS. 10A and 10B, the sheet discharging direction of the sheet P to be discharged from the nip region can be adjusted. A width of the nip region in the frontward/rearward direction can be also changed because the configuration of the pressure roller 150 is changed when adjusting the sheet discharging direction. Incidentally, when the nip plate 130 is moved to the first position from the second position, the above described operation is performed in reverse order.

The fixing device 100 according to the first embodiment provides the following advantages and effects: Movement of the nip plate 130 in the frontward/rearward direction changes the configuration of the pressure roller 150, thereby adjusting the sheet discharging direction.

The release mechanism CM for releasing the nip pressure between the nip plate 130 and the pressure roller 150 is provided. Thus, the nip plate 130 can be smoothly moved in the frontward/rearward direction.

Figure 11A:
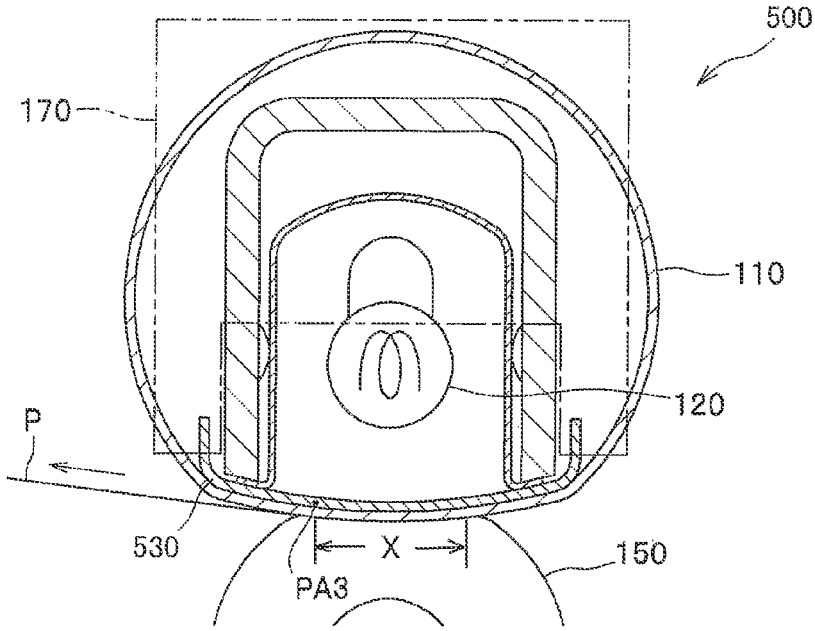
FIGS. 11A and 11B are explanatory views of a fixing device according to a second embodiment of the present invention, in which a lower surface of the nip plate is configured to be curved where a portion of the lower surface pressed by the pressure roller shown in FIG. 11A has a curvature the same as a curvature of a portion of the lower surface pressed by the pressure roller shown in FIG. 11B.
Figure 11B:
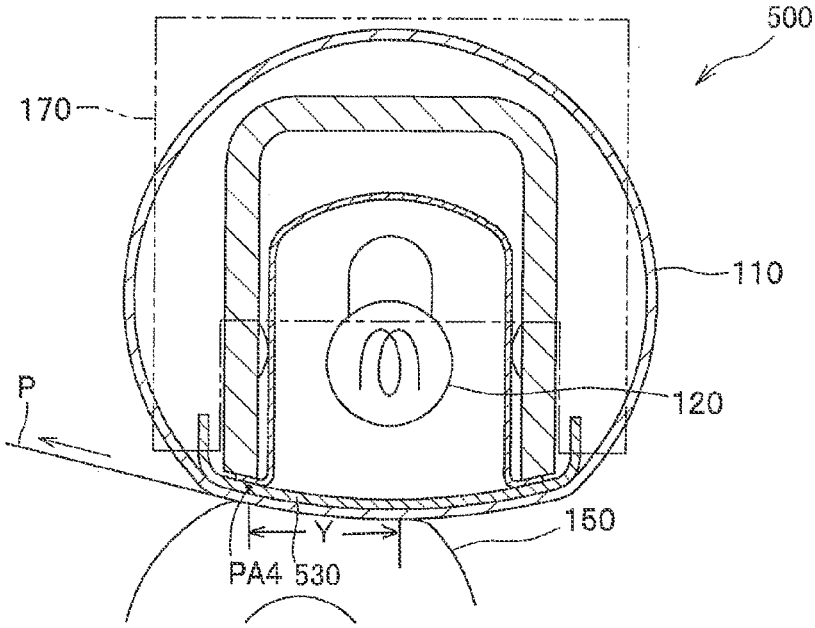

A fixing device 500 according to a second embodiment of the present invention is shown in FIGS. 11A and 11B. In the first embodiment, the lower surface of the nip plate 130 is configured such that the curvature of the portion PA1 is different from the curvature of the portion PA2. However, in the second embodiment, a lower surface of a nip plate 530 has a region X including a portion PA3 that is pressed by the pressure roller 150 and a region Y including a portion PA4 that is pressed by the pressure roller 150. The lower surface has an arcuate shape. The lower surface is configured to be curved so that the portion PA3 has a curvature the same as that of the portion PA4. The portion PA3 is a most downstream portion of the lower surface pressed by the pressure roller 150 in the sheet feeding direction when the nip plate 530 is at the first position. The portion PA4 is a most downstream portion of the lower surface pressed by the pressure roller 150 in the sheet feeding direction when the nip plate 530 is at the second position. The region X is partly overlapped with the region Y. Even if this is the case, the configuration of the pressure roller 150 can be changed in association with movement of the nip plate 530 from the first position to the second position. Hence, the sheet discharging direction can be adjusted.

Figure 12:
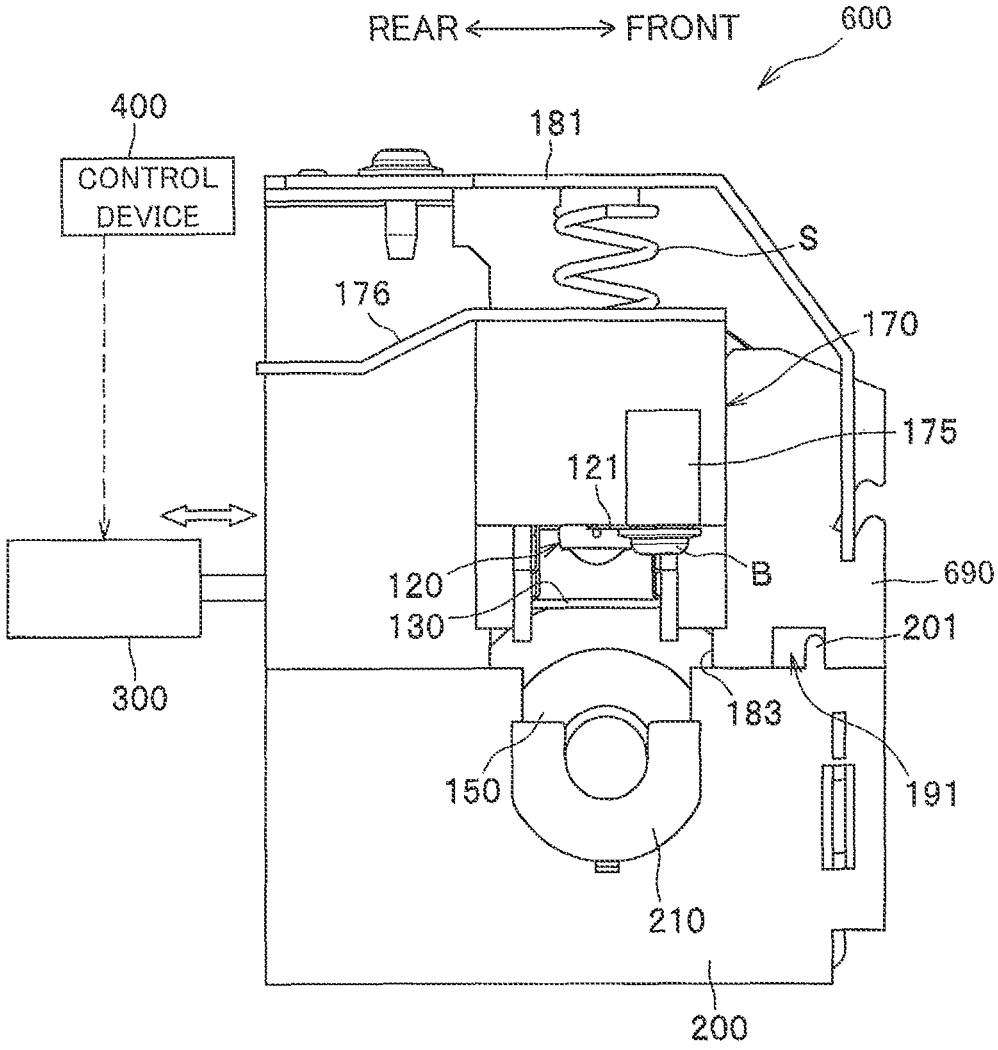
FIG. 12 is a left side view showing a drive mechanism for driving an upper casing by an actuator in a fixing device according to a third embodiment of the present invention.

A fixing device 600 according to a third embodiment of the present invention is shown in FIG. 12. In the first embodiment, the release mechanism CM for releasing the nip pressure between the nip plate 130 and the pressure roller 150 is provided in the upper casing 190. However, in the third embodiment, the release mechanism CM can be dispensed with. An upper casing 690 is not provided with the release mechanism CM. That is, without releasing the nip pressure between the nip plate 130 and the pressure roller 150, the nip plate 130 (the upper casing 690) can be moved in the frontward/rearward direction. As shown in FIG. 12, the upper casing 690 has a drive source such as an actuator 300 to automatically move the nip plate 130 (the upper casing 690) in the frontward/rearward direction.

Figure 13:
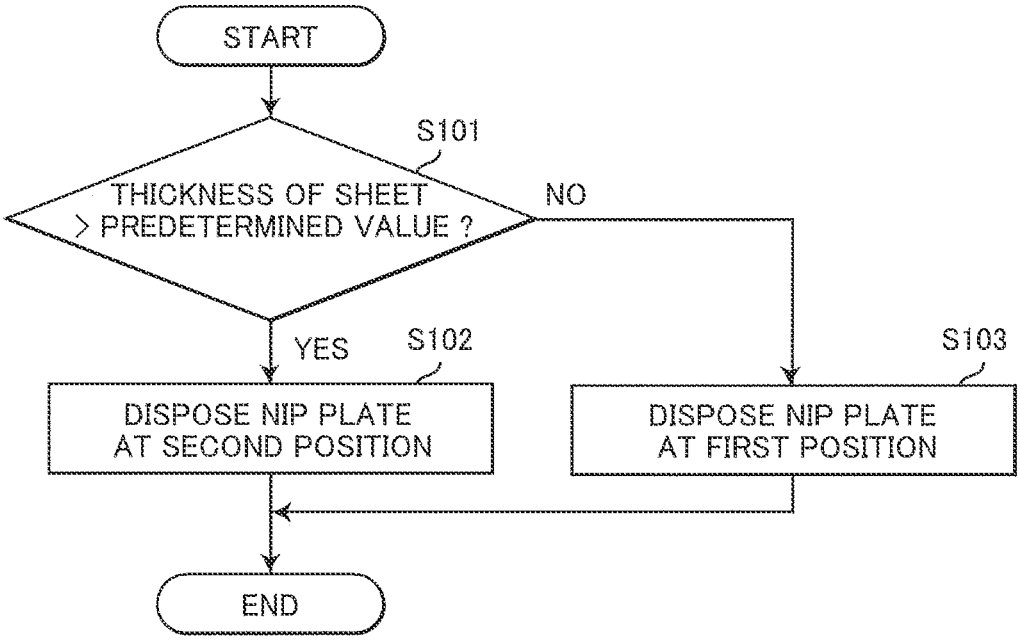
FIG. 13 is a flowchart illustrating steps in an operation of a control device shown in FIG. 12.

In such configuration that the nip plate 130 is automatically moved by the actuator 300, a control device 400 is configured to control the nip plate 130 to change its position depending on the thickness of the sheet P. More specifically, the control device 400 is configured so as to follow steps illustrated in a flowchart in FIG. 13.

If the control device 400 receives print data outputted from a personal computer to the laser printer 1 (START), the control device 400 reads out data relating to the thickness of the sheet P (for example, types of sheets, such as plain paper and a post card) from the print data, and determines whether the thickness of the sheet P is greater than a predetermined value (S101).

In S101, if the control device 400 determines that the thickness of the sheet P is greater than the predetermined value (S101: Yes), the control device 400 controls the actuator 300 (adjustment mechanism) to dispose the nip plate 130 at the second position that is positioned upstream of the first position in the sheet feeding direction (S102). Here, "to control the actuator 300 to dispose the nip plate 130 at the second position" implies that, at the time of determination of S101, if the nip plate 130 is at the first position, the control device 400 controls the actuator 300 to move the nip plate 130 to the second position and if the nip plate 130 is at the second position, the control device 400 controls the actuator 300 not to function.

In S101, if the control device 400 determines that the thickness of the sheet P is less than or equal to the predetermined value (S101: No), the control device 400 controls the actuator 300 to dispose the nip plate 130 at the first position (S103).

According to the above, if the thickness of the sheet P is greater than the predetermined value, the nip plate 130 is moved to the second position (position shown in FIG. 10B) that is positioned upstream of the first position (position shown in FIG. 10A) in the sheet feeding direction. Hence, the nip plate 130 is positioned offset from the pressure roller 150 in the sheet feeding direction. That is, a portion of the nip plate 130 is positioned upstream of the pressure roller 150 in the sheet feeding direction. As a result, in case the sheet P is thick paper, such as a post card, preheating to the sheet P can be attained by the portion of the nip plate 130 positioned upstream of the pressure roller 150, thereby improving image-fixing performance.

A fixing device 800 according to a fourth embodiment of the present invention will next be described with reference to FIGS. 14A to 19B.

Figure 19A:
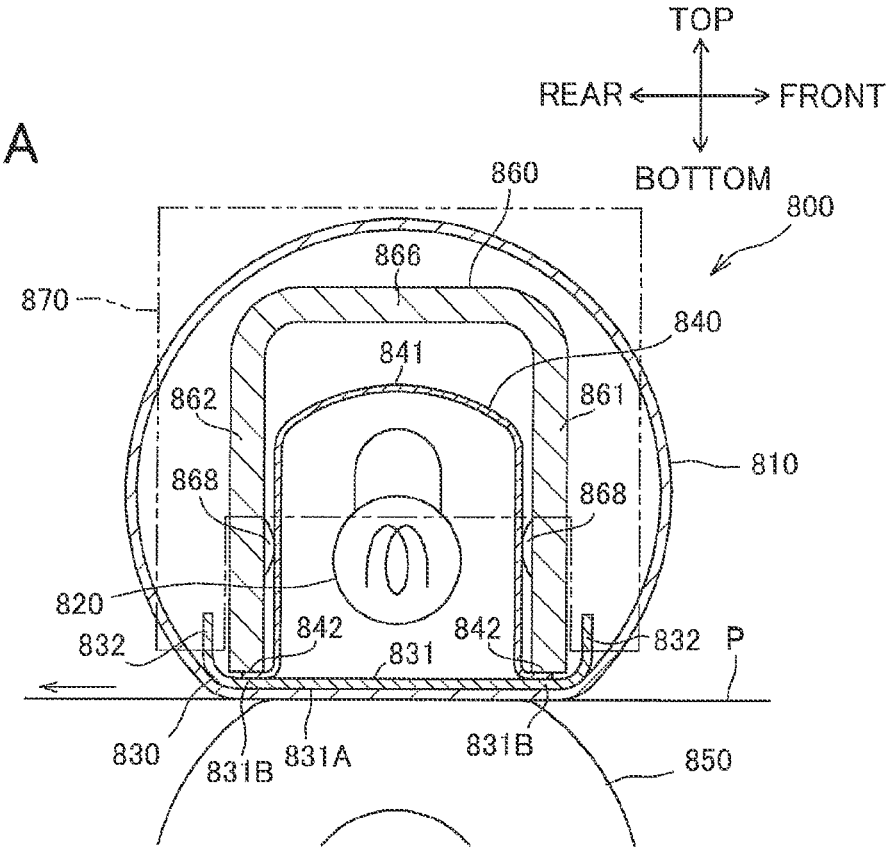
FIGS. 19A and 19B are explanatory views showing a relationship between the nip plate and a pressure roller when a sheet discharging direction is changed in the fourth embodiment.

As shown in FIG. 19A, the fixing device 800 includes a fusing film 810, a halogen lamp 820, a nip plate 830, a reflection plate 840, a pressure roller 850, and a stay 860. Since the fusing film 810, the halogen lamp 820, the nip plate 830, the reflection plate 840, the pressure roller 850, and the stay 860 are the same as the fusing film 110, the halogen lamp 120, the nip plate 130, the reflection plate 140, the pressure roller 150, and the stay 160, respectively shown in FIG. 2 in the first embodiment, description thereof will be omitted.

Figure 14A:
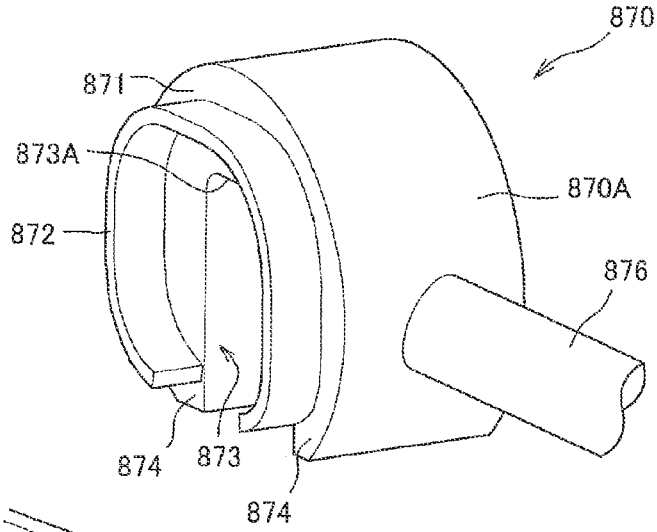
FIG. 14A is a perspective view of a guide member as viewed from a top side thereof according to a fourth embodiment.
Figure 14B:
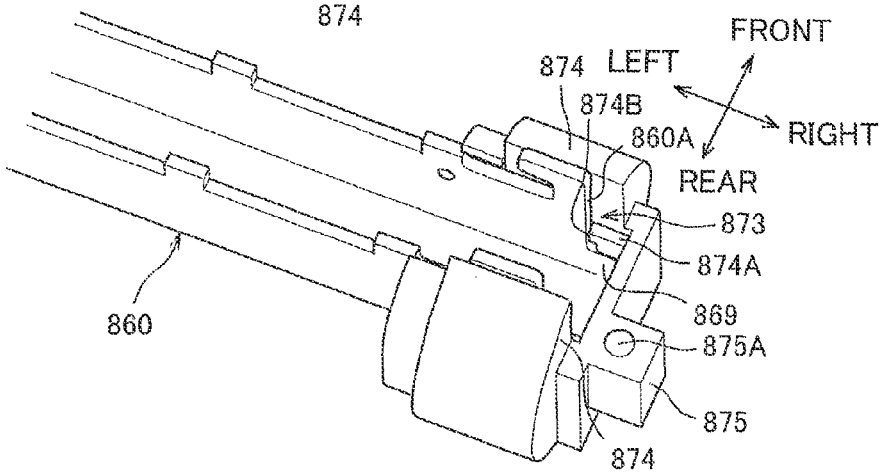
FIG. 14B is a perspective view of the guide member to which a stay is assembled as viewed from a bottom side thereof in the fourth embodiment.
Figure 14C:
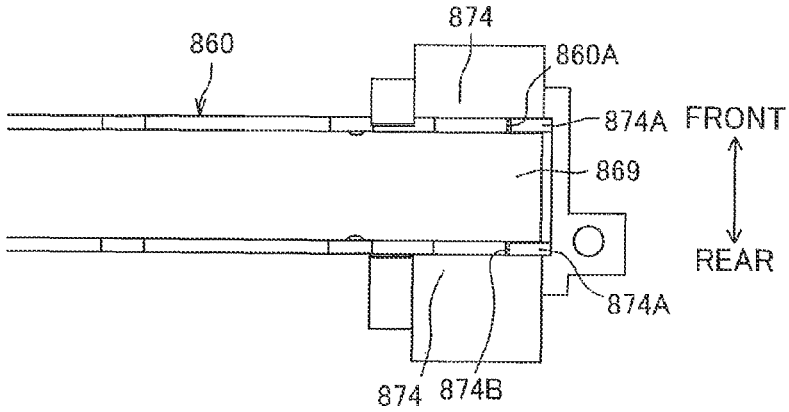
FIG. 14C is a bottom view of the guide member to which the stay is assembled in the fourth embodiment.

Further, as shown in FIGS. 14A to 14C, a guide member 870 includes a restricting surface 871, a guide portion 872, a supporting recess 873, side walls 874, and a holding portion 875. The restricting surface 871, the guide portion 872, the supporting recess 873, the side walls 874, and the holding portion 875 are the same as the restricting surface 171, the guide portion 172, the supporting recess 173, the side walls 174, and the holding portion 175, respectively shown in FIGS. 5A to 5C in the first embodiment, description thereof will be omitted.

Further, as shown in FIGS. 15 to 18, a fixing frame 880 is similar to the fixing frame 180 shown in FIGS. 6 to 9 in the first embodiment, but the upper casing 190 and the lower casing 200 are not provided.

Figure 15:
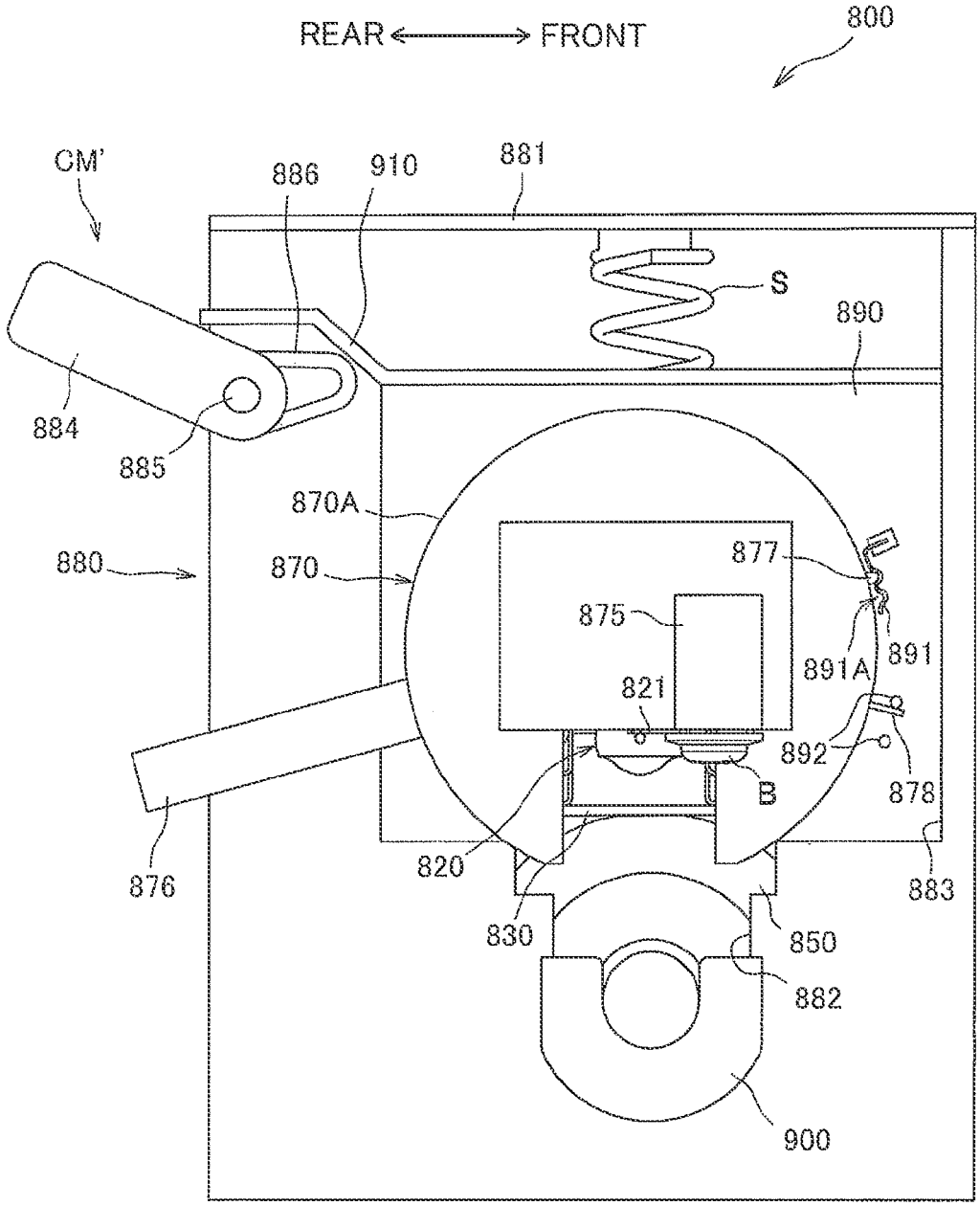
FIG. 15 is a left side view of the fixing device in which a nip plate is in a first posture in the fourth embodiment.

As shown in FIG. 15, a slide member 890 is vertically movably supported to the fixing frame 880. The slide member 890 is provided with a leaf spring 891 formed with two concave portions 891A. The two concave portions 891A, 891A are aligned in a generally vertical direction (that is, a circumferential direction of an outer peripheral surface 870A of the guide member 870), and confront the guide member 870. Further, the slide member 890 is provided with two regulation members 892 aligned in the generally vertical direction.

The guide member 870 has the outer peripheral surface 870A having a right edge portion. As shown in FIG. 15, the right edge portion of the outer peripheral surface 870A is angularly rotatably supported to the slide member 890. In other words, the nip plate 830 supported to the guide member 870 is pivotally movable about an axis of the fusing film 810 (shown in FIGS. 19A and 19B).

Further, the guide member 870 includes an operation portion 876, a first engagement portion 877 and a second engagement portion 878, each disposed on the outer peripheral surface 870A and protruding radially outwardly therefrom.

The operation portion 876 extends rearward from the outer peripheral surface 870A of the guide member 870. A user holds the operation portion 876 to angularly move the guide member 870.

The first engagement portion 877 is disposed at a front portion of the outer peripheral surface 870A of the guide member 870, and confronts the leaf spring 891. The first engagement portion 877 is selectively engageable with either one of the two concave portions 891A. When the first engagement portion 877 is brought into engagement with one of the two concave portions 891A, the concave portion 891A in engagement with the first engagement portion 877 maintains a position of the first engagement portion 877.

The second engagement portion 878 is disposed at a lower front portion of the outer peripheral surface 870A of the guide member 870. Further, the second engagement portion 878 is disposed above one of the regulation members 892 and below remaining one of the regulation members 892. The second engagement portion 878 is selectively abuttable with either one of the regulation members 892 in the circumferential direction of the guide member 870. More specifically, when the first engagement portion 877 is in engagement with the upper concave portion 891A, the second engagement portion 878 is abuttable with the upper regulation member 892, as shown in FIG. 15. When the first engagement portion 877 is in engagement with the lower concave portion 891A, the second engagement portion 878 is abuttable with the lower regulation member 892, as shown in FIG. 18.

Figure 18:
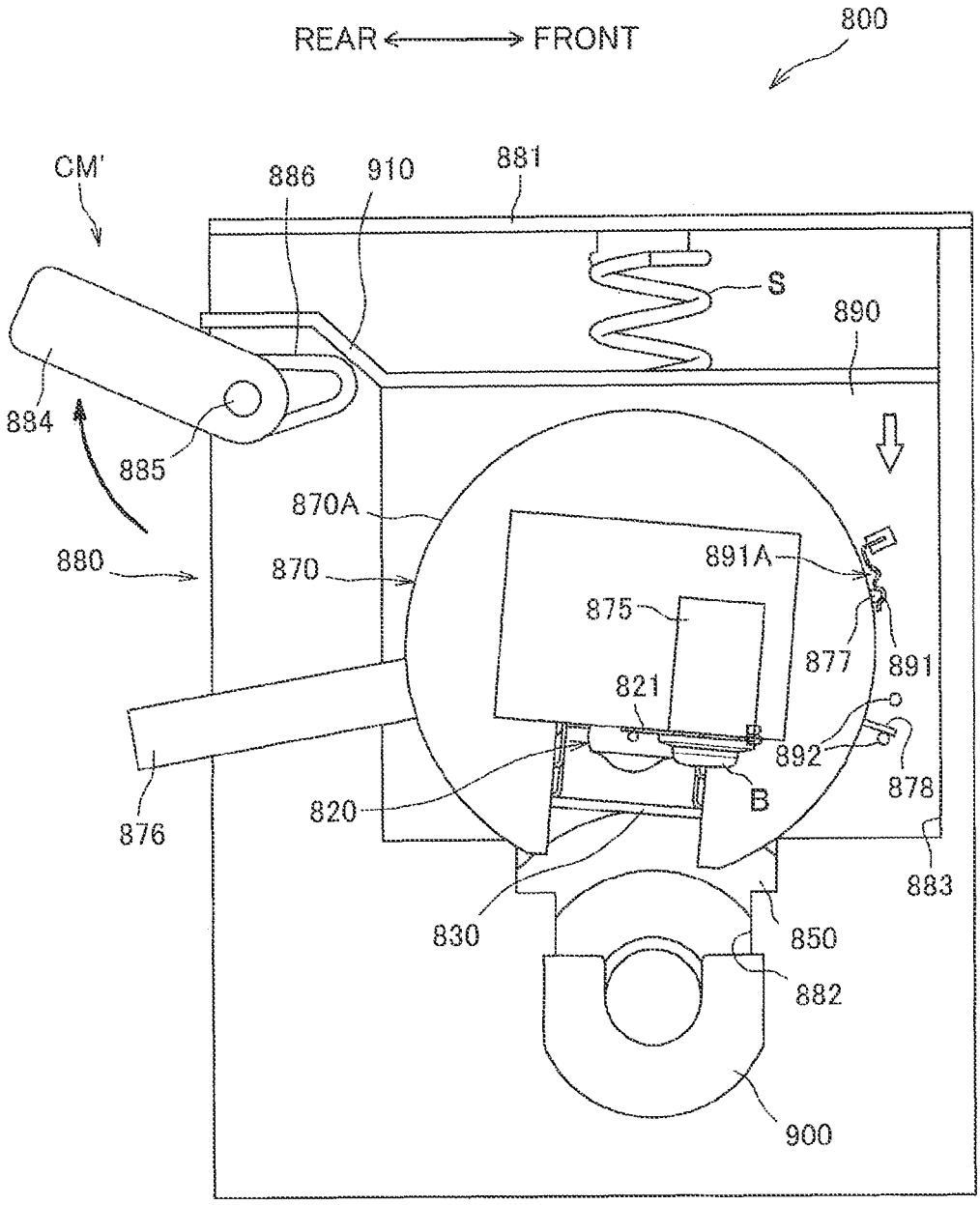
FIG. 18 is a left side view of the fixing device showing a state where the nip pressure is reapplied when the nip plate is in the second posture in the fourth embodiment.

With this configuration, the nip plate 830 supported to the guide member 870 is pivotally movable between a first posture as shown in FIG. 15 and a second posture as shown in FIG. 18, and thereby selectively maintaining the nip plate 830 at either the first posture or the second posture. That is, in the fourth embodiment, an adjustment mechanism is provided by the guide member 870 and the slide member 890 pivotally movably retaining the guide member 870 for pivotally moving the nip plate 830 between the first posture and the second posture, thereby adjusting the sheet discharging direction of the sheet P to be discharged from the nip region.

As shown in FIG. 15, the slide member 890 has an upper surface to which a support plate 910 is fixed. The support plate 910 is bent upward while extending rearward (toward a cam portion 886 described later). The fixing frame 880 has an upper portion to which an upper frame 881 is fixed. A coil spring S is disposed above the support plate 810 and below the upper frame 881. The coil spring S constantly urges the support plate 910 and the guide member 870 downward (toward the pressure roller 850) relative to the upper frame 881. With this configuration, preferable nip pressure can be applied to the nip plate 830 and the pressure roller 850 when a printing operation is performed.

The fixing frame 880 has left and right side walls, and each of the side walls is formed with a first support groove 882 and a second support groove 883. Further, each of the side walls has a bearing portion 900 in cooperation with the first support groove 882, and a shaft of the pressure roller 850 is rotatably supported in the bearing portion 900. The slide member 890 is vertically slidably retained in the second support groove 883.

As shown in FIG. 15, each of the left and right side walls of the fixing frame 880 is provided with a release mechanism CM'. With the release mechanism CM', the nip plate 830 can be moved so as to be spaced away from the pressure roller 850, thereby releasing the nip pressure between the nip plate 830 and the pressure roller 850. The release mechanism CM' includes an operation lever 884, a pivot shaft 885, and two cam portions 886.

The operation lever 884 has one end which is integrally fixed to the pivot shaft 885. The pivot shaft 885 extends in the rightward/leftward direction through holes formed in the left and right side walls of the fixing frame 880. The pivot shaft 885 is rotatably supported to the fixing frame 880.

Figure 16:
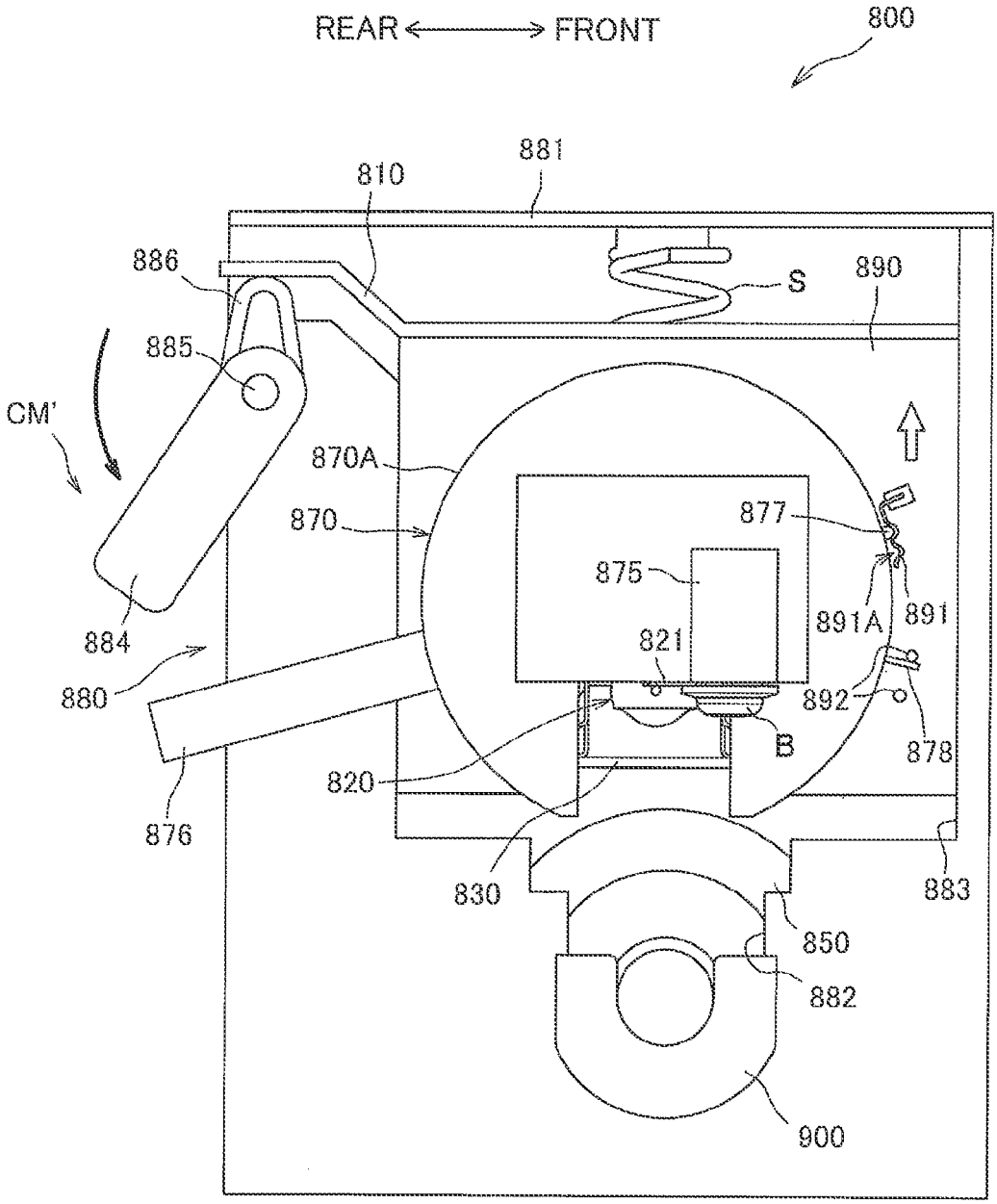
FIG. 16 is a left side view of the fixing device showing a state where a nip pressure is released when the nip plate is in the first posture in the fourth embodiment.

Each of the cam portions 886 is integrally fixed to each widthwise (left and right) end portion of the pivot shaft 885, and radially outwardly protrudes therefrom. When the operation lever 884 is pivotally moved so that the left and right cam portions 886 press the left and right support plates 910 upward respectively, the left and right slide members 890 ascend against the urging force of the coil spring S as shown in FIG. 16. As a result, the nip plate 830 is spaced away from the pressure roller 850, thereby releasing the nip pressure between the nip plate 830 and the pressure roller 850.

Figure 17:
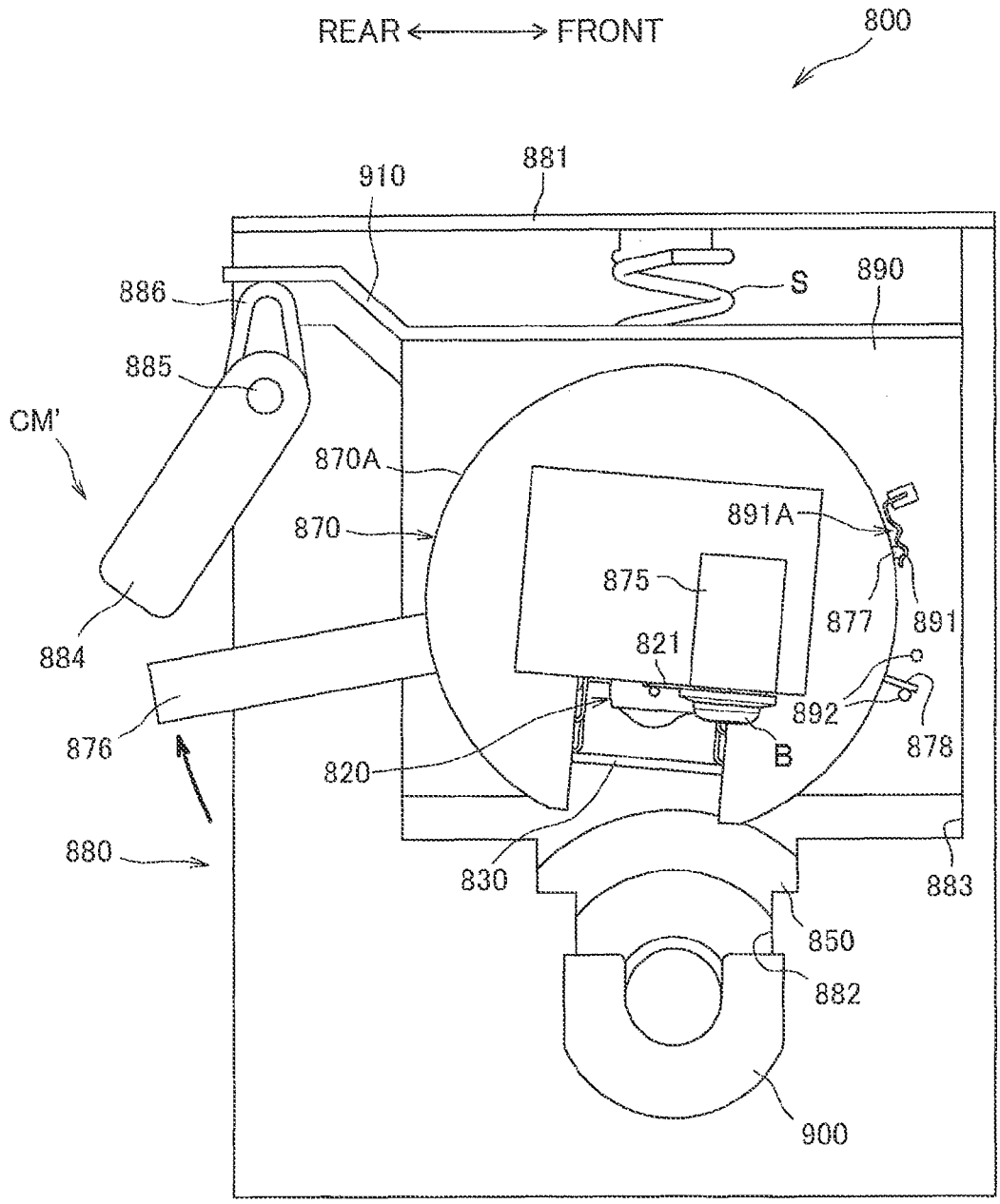
FIG. 17 is a left side view of the fixing device showing a state where the nip plate has been pivotally moved to a second posture in the fourth embodiment.

In this state, the user holds the operation portion 876 to angularly rotate the guide member 870 clockwise. As shown in FIG. 17, the nip plate 830 is pivotally moved to the second posture from the first posture. Then, as shown in FIG. 18, when the operation lever 884 is returned to its original position, the left and right cam portions 886 are moved away from the left and right support plates 910 respectively, so that the left and right slide members 890 descend by the urging force of the coil spring S. As a result, the nip plate 830 is pressed by the pressure roller 850, thereby generating the nip pressure between the nip plate 830 and the pressure roller 850.

Figure 19B:
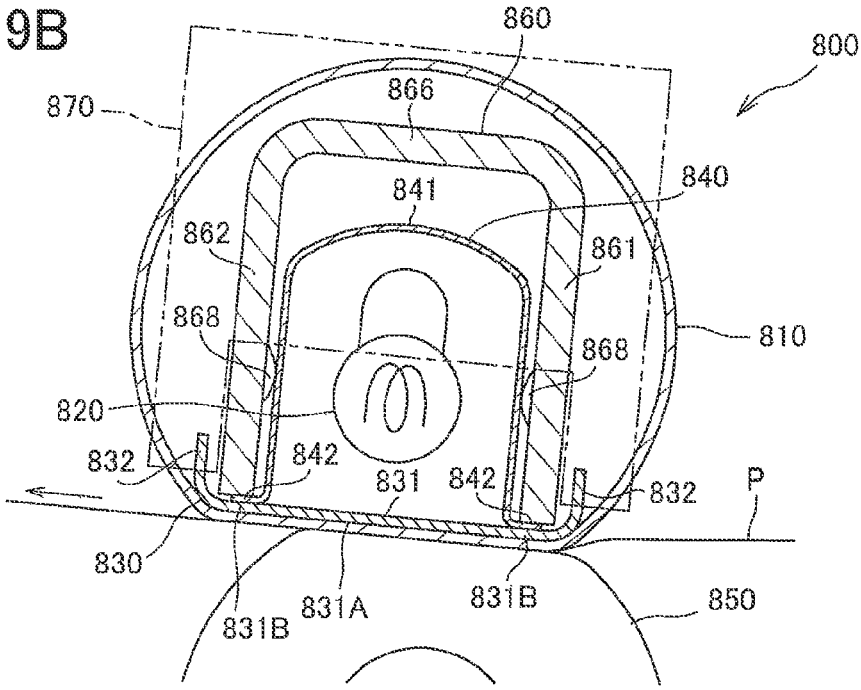

As described above, the nip plate 830 is pivotally moved to the second posture shown in FIG. 19B from the first posture shown in FIG. 19A. A lower surface 831A of the nip plate 830 has a linear region pressed by the pressure roller 850, and the linear region that has been horizontally disposed in the first posture is inclined at a prescribed angle in the second posture. The linear region pressed by the pressure roller 850 when the nip plate 830 is in the first posture is partly overlapped with the linear region pressed by the pressure roller 850 when the nip plate 830 is in the second posture. Hence, the sheet discharging direction of the sheet P to be discharged in a direction parallel to the linear region of the lower surface 831A of the nip plate 830 is changed to a direction inclined diagonally above and rearward from the horizontal direction. That is, the sheet discharging direction can be appropriately adjusted either to the horizontal direction or to the inclined direction. Incidentally, when the nip plate 830 is changed to the first posture from the second posture, the above described operation is performed in reverse order.

The fixing device 800 according to the fourth embodiment provides the following advantages and effects: the nip plate 830 is pivotally moved so that the posture of the nip plate 530 can be changed. Hence, the sheet discharging direction of the sheet P to be discharged in the direction parallel to the lower surface 831A of the nip plate 830 can be changed. Therefore, the sheet discharging direction can be adjusted.

The release mechanism CM' for releasing the nip pressure between the nip plate 830 and the pressure roller 850 is provided. Thus, the nip plate 830 can be smoothly pivotally moved.

Figure 20A:
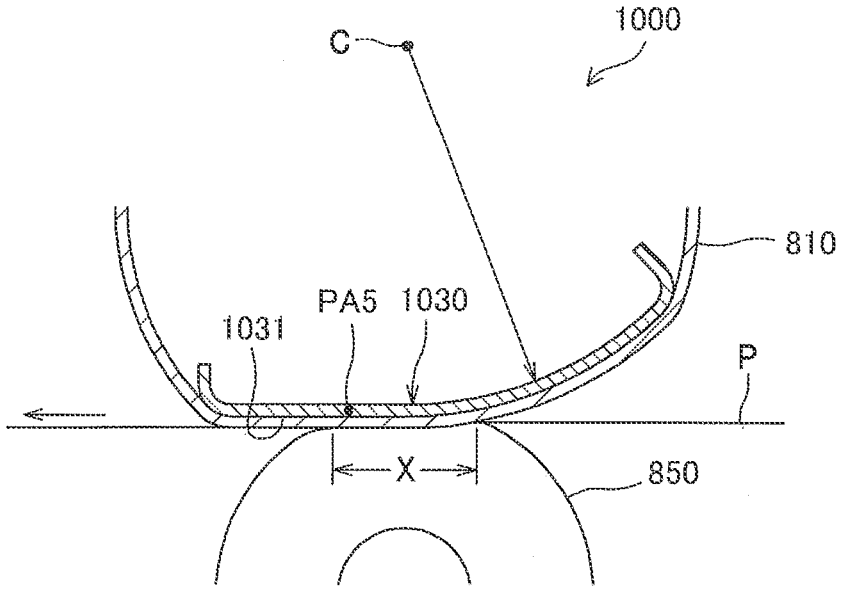
FIGS. 20A and 20B are explanatory views of a fixing device according to a fifth embodiment of the present invention, where a portion of a lower surface of a nip plate pressed by a pressure roller shown in FIG. 20A has a curvature different from a curvature of a portion of the lower surface of the nip plate pressed by the pressure roller shown in FIG. 20B.
Figure 20B:
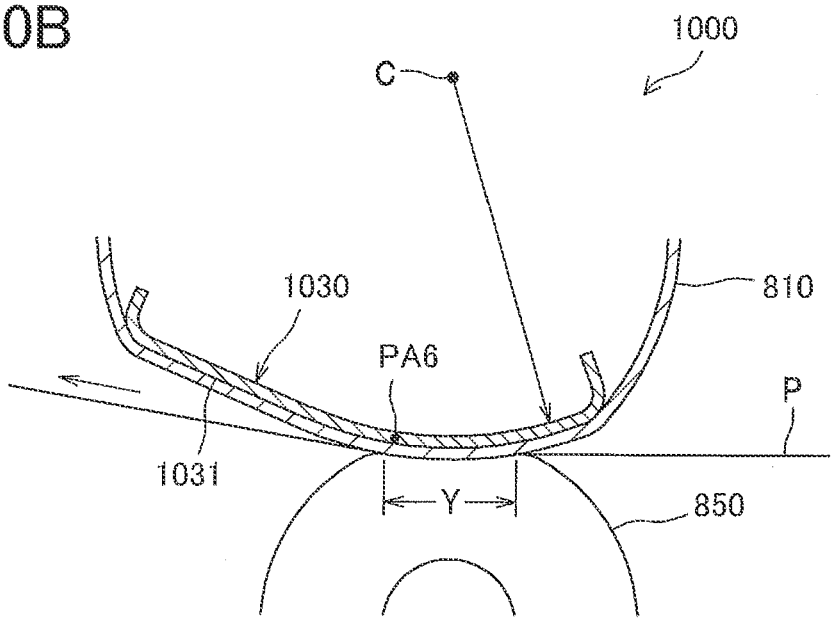

A fixing device 1000 according to a fifth embodiment of the present invention is shown in FIGS. 20A and 20B. In the fourth embodiment, the curvature of the lower surface 831A of the nip plate 830 pressed by the pressure roller 850 remains the same regardless of the pivot posture. However, in the fifth embodiment, a curvature of a lower surface 1031 of a nip plate 1030 pressed by the pressure roller 850 can vary in posture of the nip plate 1030.

For example, as shown in FIGS. 20A and 20B, the nip plate 1030 has the lower surface 1031 in which a region X including a portion PA5 and a region Y including a portion PA6 are provided. The portion PA5 is a most downstream portion of the lower surface 1031 pressed by the pressure roller 850 in the sheet feeding direction when the nip plate 1030 is in the first posture shown in FIG. 20A. The portion PA6 is a most downstream portion of the lower surface 1031 pressed by the pressure roller 850 in the sheet feeding direction when the nip plate 1030 is in the second posture. The portion PA5 can be configured to have a curvature different from a curvature of the portion PA6. With this configuration, the sheet discharging direction can be adjusted because the curvature of the portion PA5 is different from the curvature of the portion PA6. In addition, a width of the nip region in the frontward/rearward direction can be also changed.

Further, because the curvatures of the portion PA5 and the portion PA6 differ from each other according to postures of the nip plate 1030, excessive pressure of the nip plate 1030 to the pressure roller 850 can be restrained when the nip plate 1030 is pivotally moved. Accordingly, damage to the pressure roller 850 and the sheet P caused by the nip plate 1030 can be prevented.

In particular, as shown in FIGS. 20A and 20B, if the nip plate 1030 is pivotally moved about the center C of the curvature of the portion PA6, it can prevent the nip plate 1030 from unnecessarily overpressing the pressure roller 850.

Further, as shown in FIGS. 20A and 20B, the curvature of the portion PA5 of the lower surface 1031 of the nip plate 1030 in the first posture is different from the curvature of the portion PA6 of the lower surface 1031 of the nip plate 1030 in the second posture. However, the entire portion of the lower surface 1031 pressed by the pressure roller 850 can be configured to have a first curvature when the nip plate 1030 is in the first posture and a second curvature when the nip plate 1030 is in the second posture, and the second curvature is different from the first curvature. Alternatively, a most upstream portion of the lower surface 1031 of the nip plate 1030 pressed by the pressure roller 850 in the sheet feeding direction has a first curvature when the nip plate 1030 is in the first posture and a second curvature when the nip plate 1030 is in the second posture, and the second curvature is different from the first curvature.

Various modifications are conceivable. For example, in the first embodiment, the sheet discharging direction of the sheet P to be discharged from the fixing device 100 (the nip region) is changed. However, a direction of the sheet P entering into the nip region can be changed, as long as the direction is the sheet feeding direction of the sheet P. The present invention is also applicable, even if the sheet feeding direction shown in FIGS. 10A and 10B is reversed. If this is the case, a portion affecting the direction of the sheet P entering into the nip region is a most upstream portion of the lower surface of the nip plate 130 pressed by the pressure roller 150 in the sheet feeding direction. Therefore, the lower surface of the nip plate 130 can be configured such that the most upstream portion of the lower surface when the nip plate 130 is at the first position has a curvature different from a curvature of the most upstream portion of the lower surface when the nip plate 130 is at the second position.

Further, in the first embodiment, the halogen lamp 120 and the nip plate 130 are integrally retained in the guide member 170. However, the halogen lamp 120 can be fixed to the main frame 2. In this case, the nip plate 130 can be moved in the frontward/rearward direction relative to the halogen lamp 120.

In the fourth embodiment, the halogen lamp 820 and the nip plate 830 are integrally retained in the guide member 870. However, the halogen lamp 820 can be fixed to the main frame 2. In this case, the nip plate 830 can be pivotally moved relative to the halogen lamp 820.

In the fourth embodiment, the release mechanism CM' for releasing the nip pressure between the nip plate nip plate 830 and the pressure roller 850 is provided. However, the release mechanism CM' can be dispensed with. The nip plate 830 cab be pivotally moved without releasing the nip pressure.

Further, in the above-described embodiments, the fixing device includes the reflection plate and the stay. However, the reflection plate or the stay can be dispensed with.

Further, in the above-described embodiments, an infrared ray heater or a carbon heater is available instead of the halogen lamp (halogen heater).

Further, in the above-described embodiments, the nip plate is employed as a nip member. However, a thick non-planar member is also available.

Further, in the above-described embodiments, the pressure roller is employed as a backup member. However, a belt like pressure member is also available.

Further, in the above-described embodiments, the nip region is provided by the pressure contact of the nip plate (nip member) against the pressure roller (backup member). However, the nip region can also be provided by a pressure contact of the backup member against the nip member. In the latter case, a release mechanism CM is configured to move the backup member so as to be spaced away from the nip member for releasing the nip pressure between the nip member and the backup member.

Further, the sheet P can be an OHP sheet instead of plain paper and a postcard.

Further, in the above-described embodiments, the image forming device is the monochromatic laser printer. However, a color laser printer, an LED printer, a copying machine, and a multifunction device are also available.

While the invention has been described in detail with reference to the embodiment thereof, it would be apparent to those skilled in the art that various changes and modifications may be made therein without departing from the spirit of the invention.

What is claimed is:

1. A fixing device for thermally fixing a developing agent image to a sheet fed in a sheet feeding direction comprising:

a fixing frame including a first casing, and a second casing configured to be moved relative to the first casing in the sheet feeding direction;

a tubular flexible fusing member having an inner peripheral surface defining an internal space;

a heater disposed in the internal space and configured to radiate radiant heat;

a nip member disposed in the internal space and configured to receive the radiant heat from the heater, the inner peripheral surface being in sliding contact with the nip member;

a resiliently deformable backup member configured to provide a nip region in cooperation with the nip member upon nipping the fusing member between the backup member and the nip member, the backup member being configured to be rotatably supported at the first casing, the backup member confronting the nip member in a confronting direction;

a guide member configured to support the nip member, the guide member being further configured to be linearly movably supported at the second casing such that the nip member is linearly movable relative to the backup member in the confronting direction to provide a nip pressure between the nip member and the backup member and to release the nip pressure; and an adjustment mechanism configured to move the second casing relative to the first casing in the sheet feeding direction to move the nip member relative to the backup member between a first position and a second position different from the first position in the sheet feeding direction to adjust the sheet feeding direction while the nip pressure is released.

2. The fixing device as claimed in claim 1, wherein the nip member has a first region in confrontation with the backup member when the nip member is at the first position and has a second region in confrontation with the backup member when the nip member is at the second position, the first region including a first portion and the second region including a second portion, the first portion having a curvature different from that of the second portion.

3. The fixing device as claimed in claim 2, wherein the first region is partly overlapped with the second region.

4. The fixing device as claimed in claim 1, wherein the nip member has a first region in confrontation with the backup member when the nip member is at the first position and a second region in confrontation with the backup member when the nip member is at the second position, the first region including a first portion and the second region including a second portion, the first portion having a curvature equal to that of the second portion.

5. The fixing device as claimed in claim 4, wherein the first region is partly overlapped with the second region.

6. The fixing device as claimed in claim 5, wherein the first region and the second region have an arcuate shape.

7. The fixing device as claimed in claim 5, wherein the first region and the second region have a linear shape.

8. The fixing device as claimed in claim 1, further comprising a release mechanism configured to move the nip member away from the backup member to release the nip pressure between the nip member and the backup member.

9. The fixing device as claimed in claim 1, further comprising a control device configured to control the adjustment mechanism to automatically dispose the nip member at the first position if a thickness of the sheet is less than or equal to a predetermined value and to automatically dispose the nip member at the second position if the thickness of the sheet is greater than the predetermined value.

10. The fixing device as claimed in claim 1, wherein the nip member is linearly movable in a direction substantially parallel to the sheet feeding direction relative to the backup member.

11. The fixing device as claimed in claim 10, wherein the nip member has a first region in confrontation with the backup member when the nip member is at the first position and a second region in confrontation with the backup member when the nip member is at the second position, the first region including a first portion and the second region including a second portion, the first portion having a curvature different from that of the second portion.

12. The fixing device as claimed in claim 11, wherein the first region is partly overlapped with the second region.

13. The fixing device as claimed in claim 10, wherein the nip member has a first region in confrontation with the backup member when the nip member is at the first position and a second region in confrontation with the backup member when the nip member is at the second position, the first region including a first portion and the second region including a second portion, the first portion having a curvature equal to that of the second portion.

14. The fixing device as claimed in claim 13, wherein the first region is partly overlapped with the second region.

15. The fixing device as claimed in claim 13, wherein the first region and the second region have an arcuate shape.

16. The fixing device as claimed in claim 10, further comprising a control device configured to control the adjustment mechanism to automatically dispose the nip member at the first position if a thickness of the sheet is less than or equal to a predetermined value and to automatically dispose the nip member at the second position if the thickness of the sheet is greater than the predetermined value.

17. The fixing device as claimed in claim 10, further comprising a release mechanism configured to move the nip member away from the backup member to release the nip pressure between the nip member and the backup member.

18. The fixing device as claimed in claim 1, wherein the first position is positioned upstream of the second position in the sheet feeding direction.

19. The fixing device as claimed in claim 1, wherein the fusing member defines an axis, and wherein the nip member is pivotally movable about an imaginary axis parallel to the axis of the fusing member to selectively provide a first pivot posture as the first position and a second pivot posture as the second position.

20. The fixing device as claimed in claim 19, wherein the nip member has a first region in confrontation with the backup member when the nip member is at the first position and a second region in confrontation with the backup member when the nip member is at the second position, the first region including a first portion and the second region including a second portion, the first portion having a curvature different from that of the second portion.

21. The fixing device as claimed in claim 20, wherein the first region is partly overlapped with the second region.

22. The fixing device as claimed in claim 19, wherein the nip member has a first region in confrontation with the backup member when the nip member is at the first position and a second region in confrontation with the backup member when the nip member is at the second position, the first region including a first portion and the second region including a second portion, the first portion having a curvature equal to that of the second portion.

23. The fixing device as claimed in claim 22, wherein the first region is partly overlapped with the second region.

24. The fixing device as claimed in claim 22, wherein the first region and the second region have a linear shape.

25. The fixing device as claimed in claim 19, further comprising a release mechanism configured to move one of the nip member and the backup member away from the other one of the nip member and the backup member to release a nip pressure between the nip member and the backup member.

* * * * *